US007920104B2

(12) United States Patent
Kim et al.

(10) Patent No.: US 7,920,104 B2
(45) Date of Patent: Apr. 5, 2011

(54) PLASMA DISPLAY APPARATUS

(75) Inventors: Won Jae Kim, Masan-si (KR); Won Soon Kim, Gumi-si (KR); Sung Im Lee, Gumi-si (KR); Choon Sub Kim, Hwasung-si (KR)

(73) Assignee: LG Electronics Inc., Seoul (KR)

( * ) Notice: Subject to any disclaimer, the term of this patent is extended or adjusted under 35 U.S.C. 154(b) by 1119 days.

(21) Appl. No.: 11/652,673

(22) Filed: Jan. 12, 2007

(65) Prior Publication Data

US 2007/0268284 A1 Nov. 22, 2007

(30) Foreign Application Priority Data

May 19, 2006 (KR) ..... 10-2006-0045084
May 19, 2006 (KR) ..... 10-2006-0045085
May 19, 2006 (KR) ..... 10-2006-0045086

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4
See application file for complete search history.

(56) References Cited

U.S. PATENT DOCUMENTS

| | | | | |
|---|---|---|---|---|
| 7,486,257 | B2 * | 2/2009 | Kim et al. | 345/60 |
| 2002/0140639 | A1 | 10/2002 | Sakita | 345/60 |
| 2004/0252081 | A1 * | 12/2004 | Choi | 345/60 |
| 2005/0110709 | A1 | 5/2005 | Lee | 345/60 |
| 2005/0231440 | A1 | 10/2005 | Inoue et al. | 345/60 |
| 2005/0243026 | A1 | 11/2005 | Kim et al. | 345/60 |
| 2006/0145954 | A1 * | 7/2006 | Kubota et al. | 345/66 |
| 2006/0158389 | A1 * | 7/2006 | Moon | 345/67 |
| 2006/0267874 | A1 * | 11/2006 | Chen et al. | 345/68 |
| 2007/0091024 | A1 * | 4/2007 | Lin | 345/68 |
| 2007/0188416 | A1 * | 8/2007 | Inoue | 345/68 |
| 2009/0009430 | A1 * | 1/2009 | Seo et al. | 345/60 |
| 2009/0146922 | A1 * | 6/2009 | Yoshihama et al. | 345/60 |

FOREIGN PATENT DOCUMENTS

| | | | |
|---|---|---|---|
| CN | 1652176 | A | 8/2005 |
| EP | 1 233 396 | A2 | 8/2002 |
| EP | 1 271 462 | A2 | 1/2003 |
| KR | 10-2005-0089580 | A | 9/2005 |

OTHER PUBLICATIONS

Korean Office Action dated Jun. 25, 2006.
European Search Report dated May 25, 2009.
Chinese Office Action dated Jul. 3, 2009.
European Patent Office Communication dated May 31, 2010 issued in Application No. 07 250 118.2.

* cited by examiner

*Primary Examiner* — Kimnhung Nguyen
(74) *Attorney, Agent, or Firm* — Ked & Associates, LLP

(57) ABSTRACT

Provided is a plasma display apparatus having a plasma display panel constituted of a plurality of discharge cells, and a driver for driving the panel. The apparatus includes a scan IC (integrated circuit) having a first switch turning on to apply a first signal to the panel, and a second switch turning on to apply a second signal to the panel, wherein, when the first signal applied to the panel changes into the second signal, the first and second switches are floated between an application period of the first signal and an application period of the second signal.

18 Claims, 20 Drawing Sheets

PLASMA DISPLAY APPARATUS

This Nonprovisional application claims priority under 35 U.S.C. §119(a) on Patent Application No. 10-2006-0045084 filed in Korea on May 19, 2006, Patent Application No. 10-2006-0045085 filed in Korea on May 19, 2006 and Patent Application No. 10-2006-0045086 filed in Korea on May 19, 2006, the entire contents of which are hereby incorporated by reference.

BACKGROUND OF THE INVENTION

1. Field of the Invention

The present invention relates to a plasma display apparatus, and more particularly, to a plasma display apparatus in which a scan integrated circuit (IC) connecting to a panel includes a first switch and a second switch, and the first switch and the second switch are simultaneously floated in a reset period, an address period, and a sustain period, thereby preventing a peaking current caused by a short-circuit of a parasitic capacitor, from being supplied to the panel.

2. Description of the Background Art

In general, a plasma display panel refers to a device for displaying an image by applying a predetermined voltage to electrodes installed in a discharge space, inducing a discharge, and exciting phosphors using plasma generated in gas discharge.

The plasma display panel has an advantage of not only facilitating scale-up and thinning but also being simplified in structure, thereby facilitating manufacture and together, providing great luminance and emission efficiency comparing to other flat display apparatus.

At present, a popular surface discharge type plasma display panel includes a scan electrode (Y), a sustain electrode (Z), and an address electrode (X). Each of the electrodes is driven by a driving unit having a scan driving circuit, a sustain driving circuit, and an address driving circuit.

In particular, the scan driving circuit includes a scan IC constituted of a first switch and a second switch. In case where a driving signal is supplied during a reset period, an address period, and a sustain period, the first switch and the second switch are complementarily switched when there are a rise and a fall to an initiation voltage of each period.

In case where the first switch and the second switch are complementarily switched, there is a drawback in that one of the first switch and the second switch is spontaneously short-circuited by a parasitic capacitor, and the first switch and the second switch are simultaneously conducted, thereby supplying a peaking current to the scan IC.

SUMMARY OF THE INVENTION

Accordingly, the present invention is to solve at least the problems and disadvantages of the background art.

The present invention is to provide a plasma display apparatus for simultaneously floating a first switch and a second switch within a scan IC, which connects with a panel and supplies a driving signal.

To achieve these and other advantages and in accordance with the purpose of the present invention, as embodied and broadly described, there is provided a plasma display apparatus having a plasma display panel constituted of a plurality of discharge cells, and a driver for driving the panel. The apparatus includes a scan IC (integrated circuit) having a first switch turning on to apply a first signal to the panel, and a second switch turning on to apply a second signal to the panel, wherein, when the first signal applied to the panel changes into the second signal, the first and second switches are floated between an application period of the first signal and an application period of the second signal.

A cross terminal voltage of the second switch may be the same at a time point of applying the second signal to the panel.

A voltage supplied to the panel may rise or fall by 20V to 50V during floating periods of the first and second switches.

The first and second switches may be floated during 8 μs to 12 μs.

The apparatus may further include an energy recovery unit for recovering and storing energy supplied to the panel, and supplying the stored energy to the panel, wherein, while the first and second switches are floated, the energy recovery unit supplies the energy to the panel or recovers the energy from the panel.

A cross terminal voltage of the second switch may be made identical by the energy supplied from or recovered to the energy recovery unit.

The scan IC may further include a diode connecting between both terminals of the second switch, and may flow an electric current to the diode while the first and second switches are floated.

The scan IC may sequentially apply gradually rising first setup signal and second setup signal to the panel to initialize the plurality of discharge cells. The first and second switches may be floated between an application period of the first setup signal and an application period of the second setup signal.

The scan IC may sequentially apply a gradually rising setup signal and a gradually falling setdown signal to the panel to initialize the plurality of discharge cells. The first and second switches may be floated between an application period of the setup signal and an application period of the setdown signal.

The scan IC may apply a gradually falling setdown signal to the panel to initialize the plurality of discharge cells and then, apply a scan signal for selecting the discharge cell to induce a discharge from the plurality of discharge cells, to the panel. The first and second switches may be floated between an application period of the setdown signal and an application period of the scan signal.

The scan IC may apply a scan signal for selecting the discharge cell to induce a discharge from the plurality of discharge cells, to the panel, and then apply a sustain signal to the panel to induce a sustain discharge in the selected discharge cell. The first and second switches may be floated between an application period of the scan signal and an application period of the sustain signal.

In another aspect, there is provided a plasma display apparatus having a plasma display panel constituted of a plurality of discharge cells, and a driver for driving the panel. The apparatus include an energy recovery unit, a reset driving unit, and a scan IC. The energy recovery unit recovers and stores energy supplied to the panel, and supplies the stored energy to the panel. The reset driving unit generates a gradually rising setup signal and a gradually falling setdown signal to initialize the plurality of discharge cells. The scan IC has a first switch turning on to apply the generated setup signal to the panel, and a second switch turning on to apply the setdown signal to the panel. The first and second switches are floated between an application period of the setup signal and an application period of the setdown signal.

The setup signal may include a first setup signal and a second setup signal gradually rising, respectively. The first and second switches may be floated between an application period of the first setup signal and an application period of the second setup signal.

A cross terminal voltage of the second switch may be the same at a time point of applying the setdown signal to the panel.

The scan IC may further include a second diode connecting between both terminals of the second switch. While the first and second switches are floated, energy is supplied from the energy recovery unit to the panel through the second diode.

The scan IC may further include a first diode connecting between both terminals of the first switch. While the first and second switches are floated between the first setup signal application period and the second setup signal application period, energy is recovered from the panel to the energy recovery unit through the first diode.

In a further another aspect, there is provided a plasma display apparatus having a plasma display panel, which is driven by dividing one subfield into a reset period for initializing a plurality of discharge cells, an address period for selecting the discharge cell to induce a discharge from the plurality of discharge cells, and a sustain period for generating a sustain discharge in the selected discharge cell. The apparatus includes a scan IC having a first switch turning on to apply a first signal to the panel, and a second switch turning on to apply a second signal to the panel, wherein the first and second switches are floated between the address period and the sustain period.

The first and second switches may be floated between the reset period and the address period.

The scan IC may further include a second diode connecting between both terminals of the second switch. While the first and second switches are floated, energy is supplied from the energy recovery unit to the panel through the second diode.

The scan IC may further include a first diode connecting between both terminals of the first switch. While the first and second switches are floated between the reset period and the address period, energy is recovered from the panel to the energy recovery unit through the first diode.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

However, it is expressed that a plasma display apparatus according to the present invention can be modified by a plurality of exemplary embodiments without being limited to exemplary embodiments disclosed in this specification.

Figure 1:
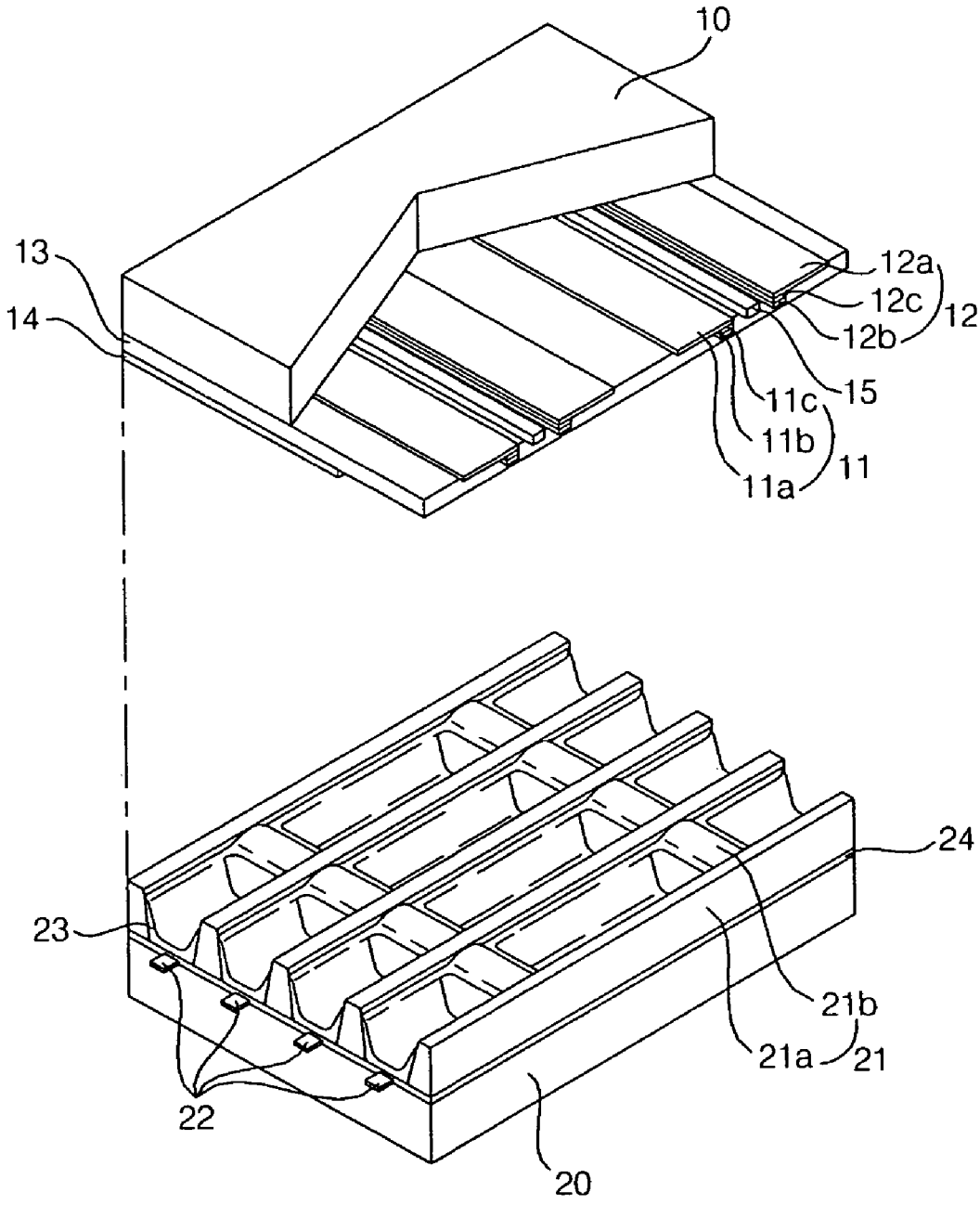
FIG. 1 is a perspective view illustrating a plasma display panel according to an exemplary embodiment of the present invention.

FIG. 1 is a perspective view illustrating the plasma display panel according to an exemplary embodiment of the present invention.

As shown in FIG. 1, the plasma display panel includes a scan electrode 11 and a sustain electrode 12 that are a sustain electrode pair provided on an upper substrate 10, and an address electrode 22 provided on a lower substrate 20.

The sustain electrode pair 11 and 12 includes transparent electrodes 11*a* and 12*a* and bus electrodes 11*b* and 12*b* that are formed of indium-tin-oxide (ITO). The bus electrodes 11*b* and 12*b* can be provided in a laminate type of metal such as silver (Ag) and chrome (Cr) or chrome/copper/chrome (Cr/Cu/Cr), or in a laminate type of chrome/aluminum/chrome (Cr/Al/Cr). The bus electrodes 11*b* and 12*b* are provided on the transparent electrodes 11*a* and 12*a*, and serve to reduce a voltage drop caused by the high-resistant transparent electrodes 11*a* and 12*a*.

According to an exemplary embodiment of the present invention, the sustain electrode pair 11 and 12 can be comprised of not only a layered structure of the transparent electrodes 11*a* and 12*a* and the bus electrodes 11*b* and 12*b*, but also a structure in which only the bus electrodes 11*b* and 12*b* are provided without the transparent electrodes 11*a* and 12*a*. This structure does not use the transparent electrodes 11*a* and 12*a*. Thus, it is advantageous of reducing a panel manufacturing cost. The bus electrodes 11*b* and 12*b* used for this structure can be of various materials such as photosensitive material, in addition to the above materials.

A black matrix (BM) is arranged between the transparent electrodes 11*a* and 12*a* and the bus electrodes 11*b* and 12*b* of the scan electrode 11 and the sustain electrode 12. The black matrix performs a light shield function of absorbing light generated outside the upper substrate 10, and reducing a reflection light, and a function of improving a purity and a contrast of the upper substrate 10.

The black matrix according to an exemplary embodiment of the present invention is provided on the upper substrate 10, and can be comprised of a first black matrix 15 provided at a position overlapping with a barrier rib 21, and second black matrixes 11*c* and 12*c* provided between the transparent electrodes 11*a* and 12*a* and the bus electrodes 11*b* and 12*b*. The first black matrix 15, and the second black matrixes 11*c* and 12*c* that are called black layers or black electrode layers, can be simultaneously formed in their forming processes and physically connected with each other, or not.

Being physically connected and formed, the first black matrix 15 and the second black matrixes 11*c* and 12*c* are formed of same material. However, being physically separated and provided, they can be formed of different materials.

An upper dielectric layer 13 and a protective film 14 are layered on the upper substrate 10 where the scan electrode 11 and the sustain electrode 12 are provided in parallel. The upper dielectric layer 13 can perform a function of storing charged particles generated by discharge, and protecting the sustain electrode pair 11 and 12. The protective film 14 protects the upper dielectric layer 13 from sputtering of the charged particles generated at the time of gas discharge, and enhances an emission efficiency of secondary electrons. Also, the protective film 14 can be formed of oxide magnesium (MgO), or can be formed of silicon (Si)-added oxide magnesium (Si—MgO). Here, a percentage of silicon (Si) added to the protective film 14 can be about 50 ppm to 200 ppm by weight percentage (wt %).

The address electrode 22 is provided in a direction intersecting with the scan electrode 11 and the sustain electrode 12. A lower dielectric layer 23 and a barrier rib 21 are provided on the lower substrate 20 having the address electrode 22.

A phosphor layer is provided on surfaces of the lower dielectric layer 23 and the barrier rib 21. The barrier rib 21 includes a vertical barrier rib 21*a* and a horizontal barrier rib 21*b* provided in a closed type. The vertical barrier rib 21*a* and the horizontal barrier rib 21*b* physically distinguish discharge cells, and prevent ultraviolet ray and visible ray generated by the discharge from leaking to an adjacent discharge cell.

In an exemplary embodiment of the present invention, not only a structure of the barrier rib 21 shown in FIG. 1 but also a multiform structure of the barrier rib 21 is possible. For example, a differential type barrier rib structure in which the vertical barrier rib 21*a* and the horizontal rib 21*b* are different in height, a channel type barrier rib structure in which a channel used as an exhaustion passage is provided at at least one of the vertical barrier rib 21*a* and the horizontal barrier rib 21*b*, and a hollow type barrier rib structure in which hollow is provided at at least one of the vertical barrier rib 21*a* and the horizontal barrier rib 21*b*.

In the differential type barrier rib structure, it is desirable that the horizontal barrier rib 21*b* is great in height. In the channel type barrier rib structure or the hollow type barrier rib structure, it is desirable that the horizontal barrier rib 21*b* has the channel or the hollow.

In an exemplary embodiment of the present invention, it is shown and described that Red (R), Green (G), and Blue (B) discharge cells are arranged on the same line, respectively, but it also possible that they are arranged in a different type. For example, it is also possible to provide delta type arrangement in which the R, G, and B discharge cells are arranged in a triangular shape. Also, it is possible to shape the discharge cell in not only a tetragonal shape but also various polygonal shapes such as pentagonal and hexagonal shapes.

The phosphor layer is excited by the ultraviolet ray generated in the gas discharge, and generates any one of R, G, and B visible rays. An inertia mixture gas such as He+Xe, Ne+Xe, and He+Ne+Xe for discharge is injected into a discharge space provided between the upper/lower substrates 10 and 20 and the barrier rib 21.

Figure 2:
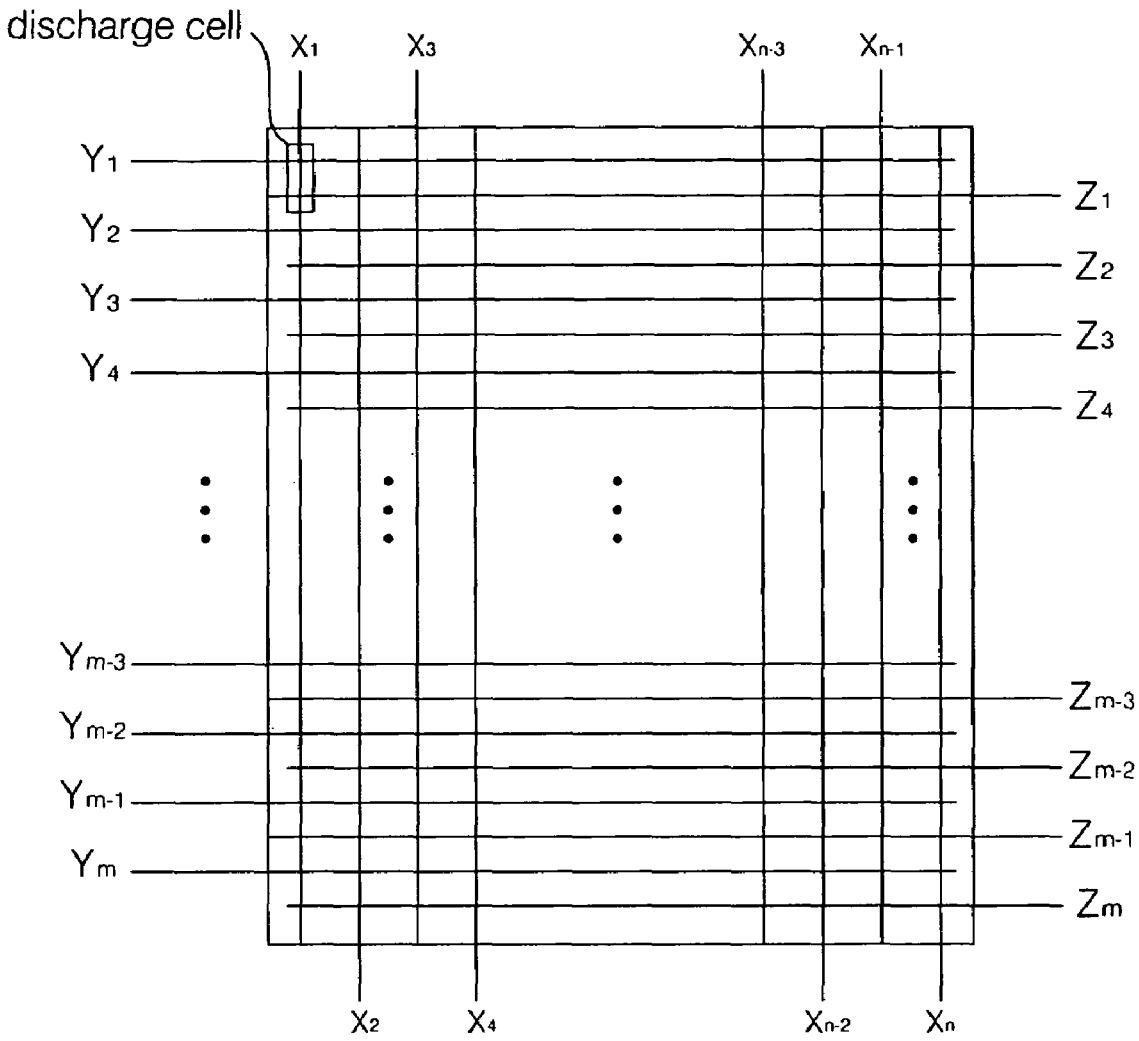
FIG. 2 illustrates an electrode arrangement of a plasma display panel according to an exemplary embodiment of the present invention.

FIG. 2 illustrates an electrode arrangement of a plasma display panel according to an exemplary embodiment of the present invention. It is desirable that a plurality of discharge cells constituting the plasma display panel is arranged in matrix as shown in FIG. 2. The plurality of discharge cells is provided at intersection portions of scan electrode lines (Y1 to Ym), sustain electrode lines (Z1 to Zm), and address electrode lines (X1 to Xn), respectively. The scan electrode lines (Y1 to Ym) can be driven in sequence or at the same time. The sustain electrode lines (Z1 to Zm) can be driven at the same time. The address electrode lines (X1 to Xn) can be divided into odd-numbered lines and even-numbered lines and driven, or can be driven in sequence.

The electrode arrangement shown in FIG. 2 is merely one exemplary electrode arrangement of the plasma display panel according to an exemplary embodiment of the present invention. Accordingly, the present invention is not limited to the electrode arrangement and a driving method of the plasma display panel shown in FIG. 2. For example, it is possible to employ even a dual scan method in which two ones of the scan electrode lines (Y1 to Ym) are scanned at the same time. Also, the address electrode lines (X1 to Xn) can be also divided into upper and lower parts at a center of the plasma display panel and driven.

Figure 3:
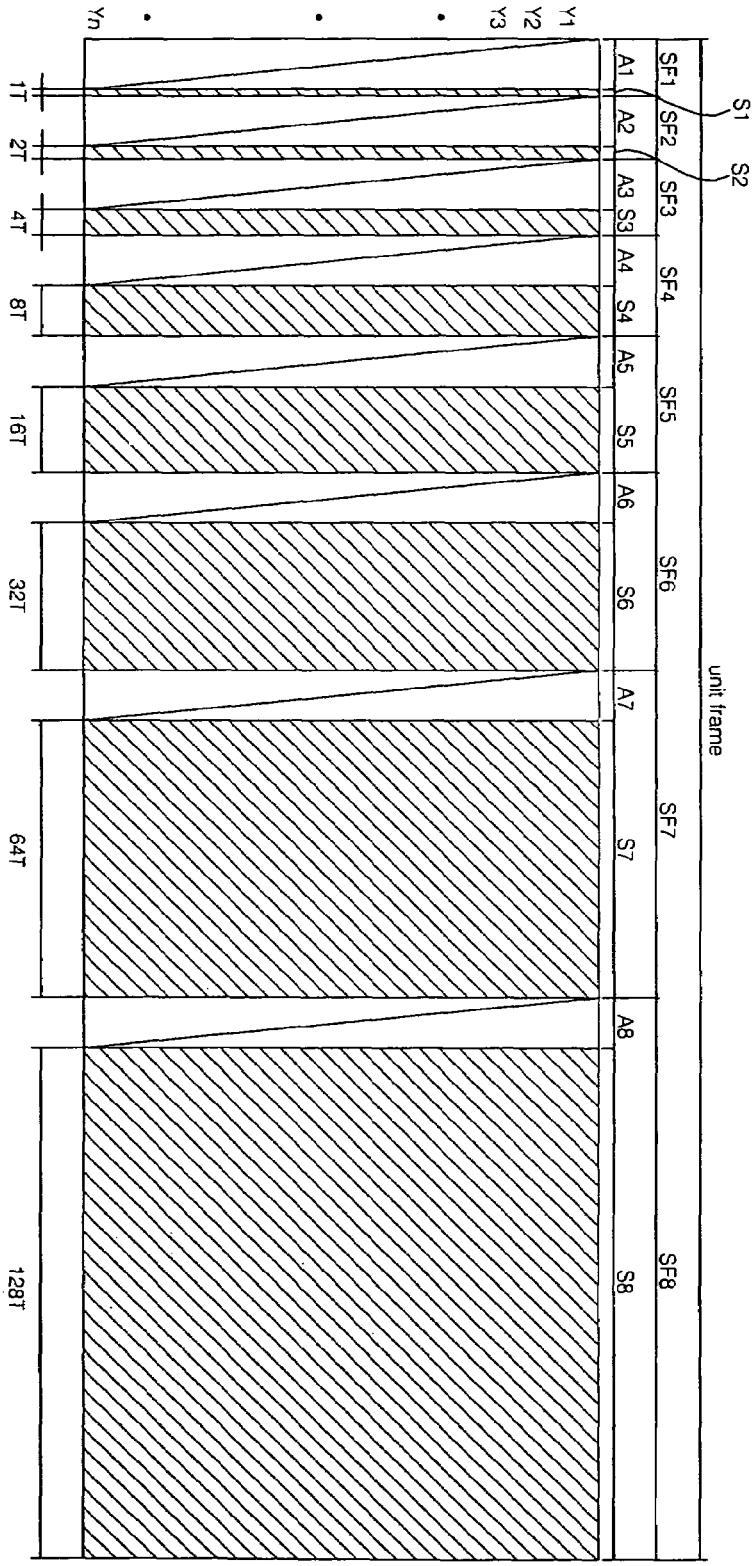
FIG. 3 is a timing diagram illustrating a time-division driving method based on one frame divided into a plurality of subfields, according to an exemplary embodiment of the present invention.

FIG. 3 is a timing diagram illustrating a time-division driving method based on one frame divided into a plurality of subfields, according to an exemplary embodiment of the present invention. A unit frame can be divided into a predetermined number of subfields, for example, eight subfields (SF1, . . . , SF8), to realize time-division grayscale display. Each of the subfields (SF1, . . . , SF8) is divided into a reset period (not shown), an address period (A1, . . . , A8), and a sustain period (S1, . . . , S8).

According to an exemplary embodiment of the present invention, the reset period can be omitted from at least one of the plurality of subfields. For example, the reset period can exist only at an initial subfield, or exist only at the initial subfield and an approximately middle subfield of a whole subfield.

In each of the sustain periods (S1, . . . , S8), the sustain pulse is alternately applied to the scan electrode (Y) and the sustain electrode (Z), and induces a sustain discharge in the discharge cells in which wall charges are formed in the address periods (A1, . . . , A8).

A luminance of the plasma display panel is proportional to the number of sustain discharge pulses in the sustain discharge periods (S1, . . . , S8) of the unit frame. In case where one frame forming a single image is expressed by eight subfields and 256 grayscales, different numbers of sustain pulses may be sequentially allocated to the respective subfields at a ratio of 1:2:4:8:16:32:64:128. Luminance corresponding to 133 grayscales can be obtained by addressing cells and sustaining a discharge during a first subfield, a third subfield, and an eighth subfield.

The number of sustain discharges allocated to each subfield can be variably determined depending on weights of the subfields according to an automatic power control (APC) level.

The number of sustain discharges allocated to each subfield can be variously changed taking account of gamma characteristics or panel characteristics. For example, a grayscale level allocated to a fourth subfield can be lowered from 8 to 6, and a grayscale level allocated to a sixth subfield can be increased from 32 to 34.

Figure 4:
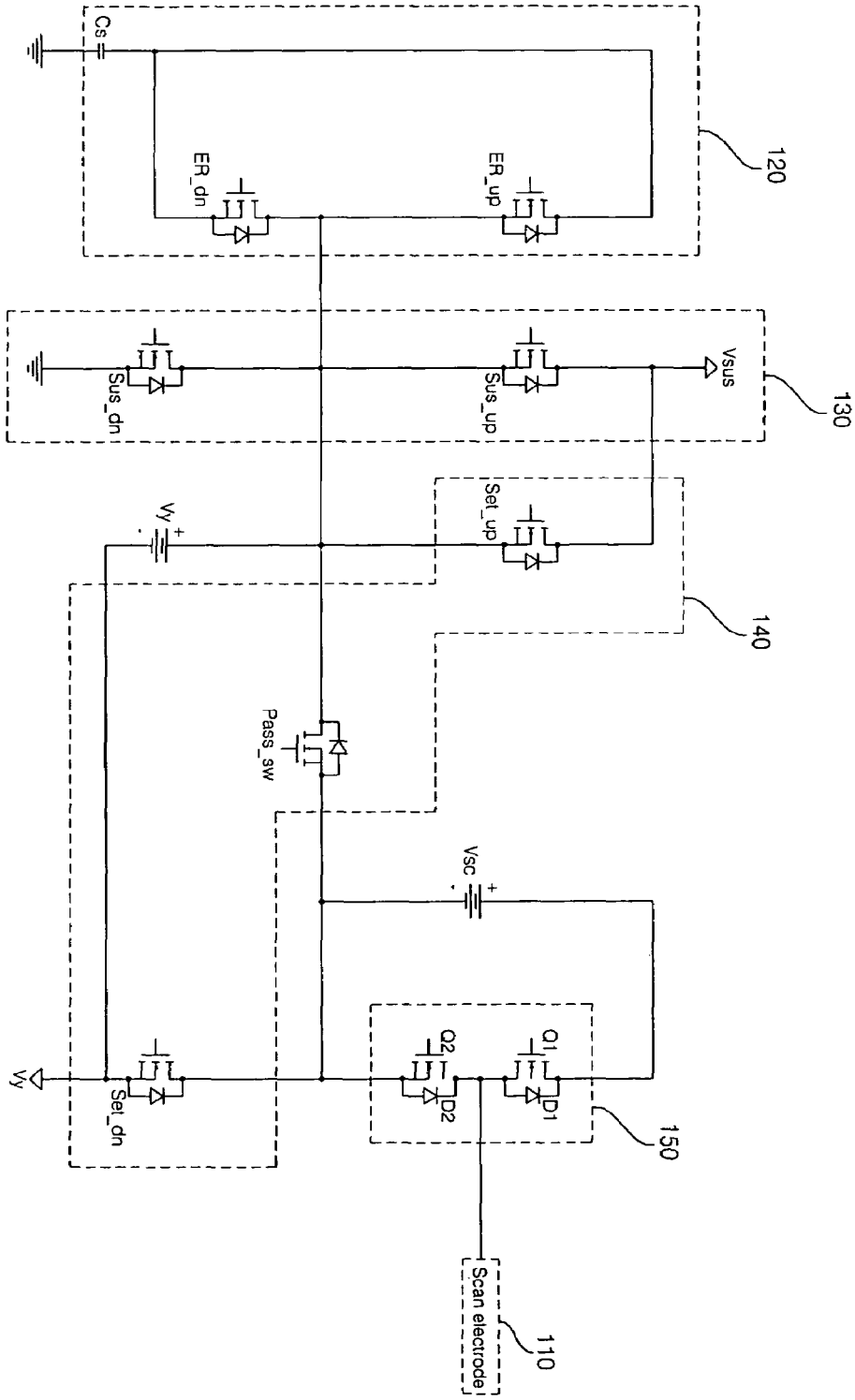
FIG. 4 is a circuit diagram illustrating a construction of a scan driving circuit for supplying a driving signal to a plasma display panel according to an exemplary embodiment of the present invention.

FIG. 4 is a circuit diagram illustrating a construction of a scan driving circuit for supplying a driving signal to the plasma display panel according to an exemplary embodiment of the present invention.

As shown in FIG. 4, the scan driving circuit includes a scan electrode 110, an energy recovery unit 120, a sustain driving unit 130, a reset driving unit 140, and a scan integrated circuit (IC) 150.

The sustain driving unit 130 includes a first power source (Vsus) for supplying a high potential sustain voltage (Vsus) during the sustain period; a sus-up switch (Sus_up) for switching and supplying a sustain voltage (Vsus) to the scan electrode 110 and a sus-down switch (Sus_dn) for switching and lowering the supplied voltage of the scan electrode 110 to a ground (GND) voltage.

In other words, in the sustain driving unit 130, the sus-up switch (Sus_up) connects with the first power source (Vsus), and the sus-down switch (Sus_dn) connects with the sus-up switch (Sus_up) and the ground (GND).

The energy recovery unit 120 includes a capacitor (Cs) for recovering and supplying the sustain voltage (Vsus) supplied to the scan electrode 110 a supply switch (ER_up) for switching and supplying the sustain voltage recovered by the capacitor (Cs), to the scan electrode 110 and a recovery switch (ER_dn) for switching and recovering the sustain voltage (Vsus) from the scan electrode 110 to the capacitor (Cs).

The reset driving unit 140 includes a setup switch (Set_up) for supplying a gradually rising setup signal to the scan electrode 110 a setdown switch (Set_dn) connecting with a negative voltage (−Vy), and supplying a setdown signal gradually falling to the negative voltage (−Vy); and a pass switch (Pass_sw) for forming a current pass path with the scan electrode 110.

The set-up switch (Set-up) has a drain connecting with the first power source (Vsus) for supplying the sustain voltage (Vsus); a source connecting with the pass switch (Pass_sw); and a gate connecting with a variable resistor (not shown). The setup switch (Set-up) generates the setup signal gradually rising depending on a variation of a resistance of the variable resistor.

The setdown switch (Set_dn) has a drain connecting with the scan IC 150 a source connecting with the negative voltage (−Vy); and a gate connecting with a variable resistor (not shown). The setdown switch (Set_dn) generates the setdown signal gradually falling depending on the variation of the resistance of the variable resistor.

The scan IC 150 includes a first switch (Q1) connecting with a second power source (Vsc) for supplying a scan voltage (Vsc); and a second switch (Q2) connecting with the first switch (Q1). The scan electrode 110 is connected between the first switch (Q1) and the second switch (Q2).

The scan IC 150 includes a first diode (D1) connecting in parallel with the first switch (Q1); and a second diode (D2) connecting in parallel with the second switch (Q2).

The first diode (D1) connects in parallel with the first switch (Q1), and has a cathode connecting to the drain of the first switch (Q1) and an anode connecting to the source. The second diode (D2) connects in parallel with the second switch (Q2), and has a cathode connecting with the drain of the second switch (Q2) and an anode connecting with the source.

The first and second switches (Q1) and (Q2) of the scan IC 150 according to the present invention not only perform a complementary operation, but also any one of the first and second switches Q1 and Q2 is sustained in an off state for a predetermined time so that they have the same cross terminal voltage, and supply a voltage to the scan electrode 110.

The predetermined time is preferably about 8 μs to 12 μs. The predetermined time refers to a time for making the cross terminal voltages of the first and second switches (Q1) and (Q2) identical before the first and second switches (Q1) and (Q2) are complementarily switched, by lowering capacitances of parasitic capacitors (not shown) provided within the first and second switches (Q1) and (Q2).

Figure 5:
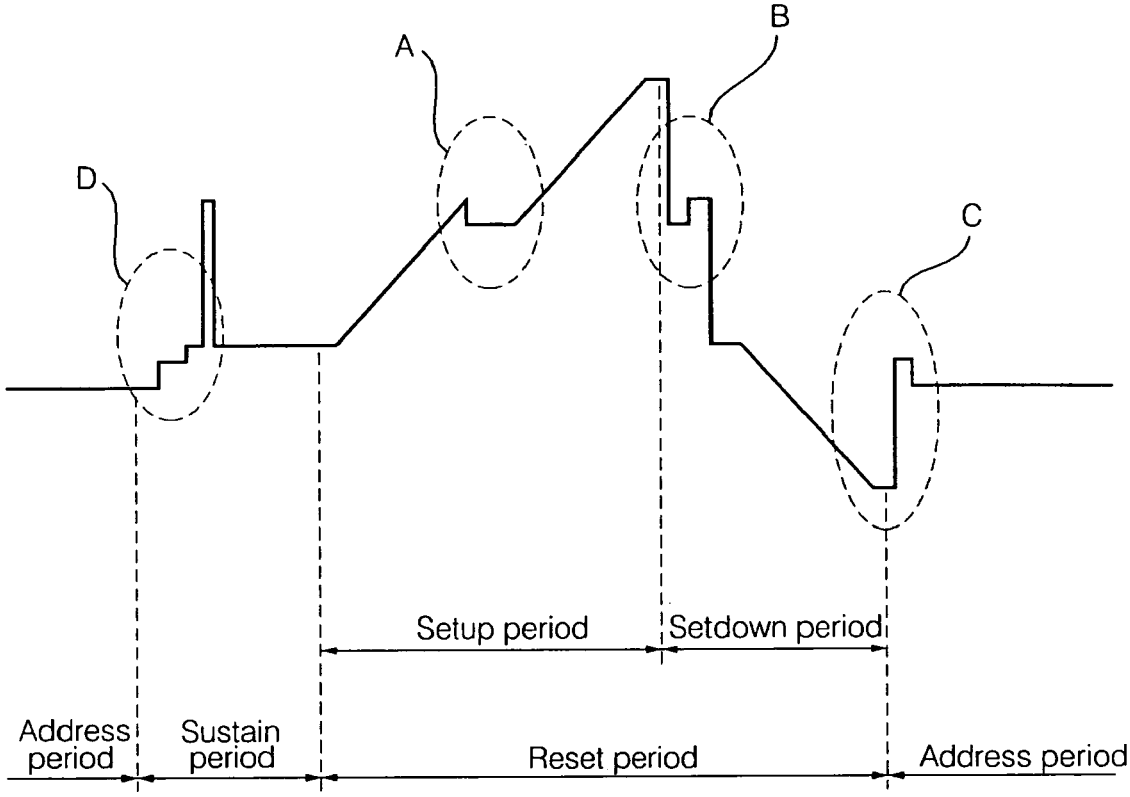
FIG. 5 is a timing diagram illustrating driving signals for driving a plasma display panel in divided one subfield according to an exemplary embodiment of the present invention.

FIG. 5 is a timing diagram illustrating driving signals for driving the plasma display panel in divided one subfield according to an exemplary embodiment of the present invention.

The subfield includes a pre reset period (not shown) for forming positive wall charges on the scan electrode (Y) and forming negative wall charges on the sustain electrode (Z); a reset period for initializing the discharge cells of a whole screen, using a distribution of the wall charges formed during the pre reset period; and an address period for selecting the discharge cell; and a sustain period for sustaining a discharge of the selected discharge cell.

The reset period includes a setup period and a setdown period. In the setup period, the gradually rising setup signal is simultaneously applied to all the scan electrodes (Y), thereby inducing a micro discharge in all the discharge cells and thus, generating the wall charges. In the setdown period, the setdown signal gradually falling from a positive voltage lower than a peak voltage of the setup signal is simultaneously applied to all the scan electrodes (Y), thereby inducing an erasure discharge in all the discharge cells and thus, erasing unnecessary charges among space charges and the wall charges generated by a setup discharge.

In the address period, a negative scan signal (scan) is sequentially applied to the scan electrode (Y) and at the same time, a positive data signal (data) is applied to the address electrode (X). A voltage difference between the scan signal (scan) and the data signal (data), and a wall voltage generated during the reset period induce an address discharge, thereby selecting the cell.

In the sustain period, the sustain signal is alternately applied to the scan electrode (Y) and the sustain electrode (Z), and the sustain discharge is induced in a surface discharge type between the scan electrode (Y) and the sustain electrode (Z).

In other words, as shown in FIG. 5, the reset period is comprised of the setup period for supplying a first setup signal gradually rising from the ground (GND) to the sustain voltage (Vsus), and a second setup signal gradually rising to a sum voltage of the scan voltage (Vsc) and the sustain voltage (Vsus); and the setdown period for supplying the setdown signal falling from the second setup signal to the ground (GND) and gradually falling to the negative voltage (−Vy).

The setup period includes a first period for supplying the first setup signal; a second period for falling by a predetermined voltage from the sustain voltage (Vsus) of the first setup signal, and sustaining a fall voltage; and a third period for supplying the second setup signal that gradually rises from the fall voltage falling by the predetermined voltage of the second period to the scan voltage (Vsc).

It is desirable that the predetermined voltage is 20V to 50V at the sustain voltage (Vsus).

The setdown period includes a setdown initiation period for falling from the sum voltage of the scan voltage (Vsc) and the sustain voltage (Vsus) of the second setup signal, to the ground (GND); and a setdown start period for supplying the setdown signal gradually falling to the negative voltage (−Vy).

The setdown initiation period includes a first period for falling from the sum voltage of the sustain voltage (Vsus) and the scan voltage (Vsc) of the setup signal; a second period for rising from the scan voltage (Vsc) to the sustain voltage (Vsus); and a third period for falling from the sustain voltage (Vsus) to the ground (GND).

In the address period, the setdown signal rises from the negative voltage (−Vy) to a scan bias voltage (Vsc−Vy), and is sustained until the scan signal is applied.

The address period includes an address initiation period. The address initiation period includes a first period for rising from the negative voltage (−Vy) by the sustain voltage (Vsus); a second period for falling from a rise voltage rising by the sustain voltage (Vsus) of the first period, to the scan bias voltage (Vsc−Vy); and a third period for sustaining the scan bias voltage (Vsc−Vy) until the scan signal is applied.

The sustain period includes a sustain initiation period for rising to the sustain voltage (Vsus) before the applying of the sustain signal for the address period.

The sustain initiation period includes a first period for rising by a predetermined voltage from the scan bias voltage (Vsc−Vy) of the address period; and a second period for rising from a rise voltage of the first period to the ground (GND).

The predetermined voltage is a difference voltage between the scan bias voltage (Vsc−Vy), and a sum voltage of the negative voltage (−Vy) and the sustain voltage (Vsus).

The driving signal shown in FIG. 5 refers to a signal for driving the plasma display panel according to a first exemplary embodiment of the present invention. The driving signal shown in FIG. 5 does not limit a scope of the present invention. For example, the pre reset period can be omitted, and the driving signals shown in FIG. 4 can change in polarity and voltage level according to need, and an erasure signal for erasing the wall charges can be applied to the sustain electrode after the sustain discharge is completed. Also, it is possible to perform single sustain driving for applying the sustain signal to only any one of the scan electrode (Y) and the sustain electrode (Z), and inducing the sustain discharge.

Figure 6:
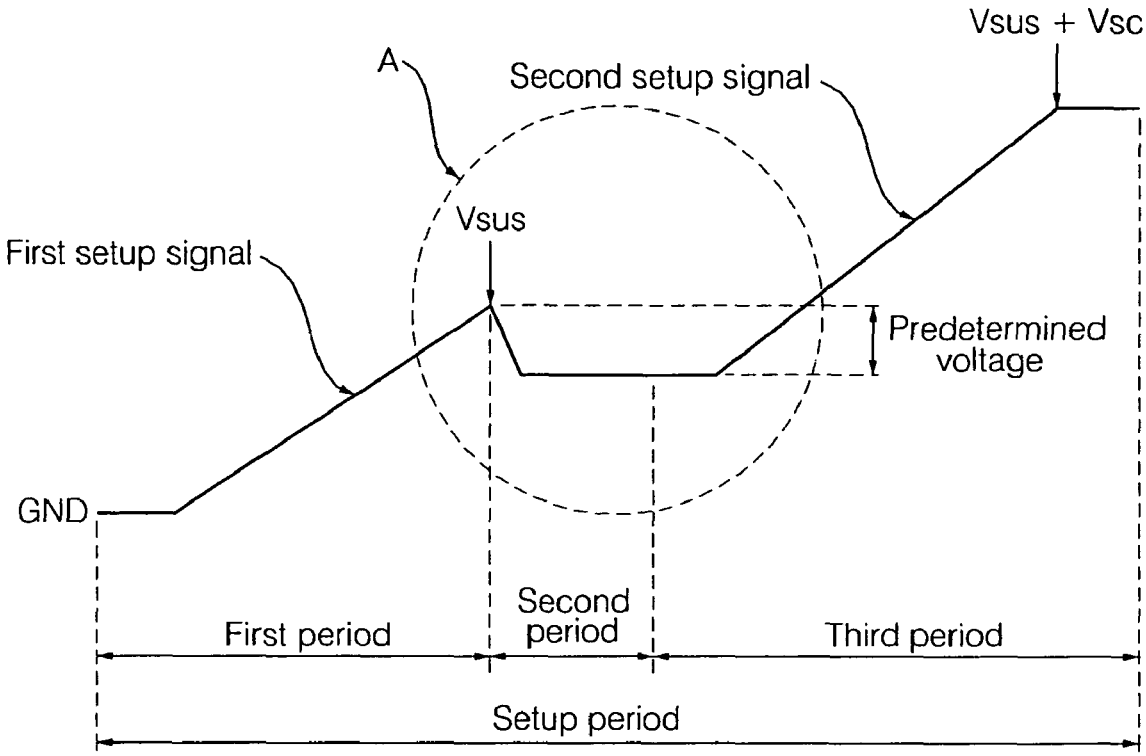
FIG. 6 is an exploded timing diagram illustrating a setup period of a driving signal supplied to a plasma display panel.
Figure 7A:
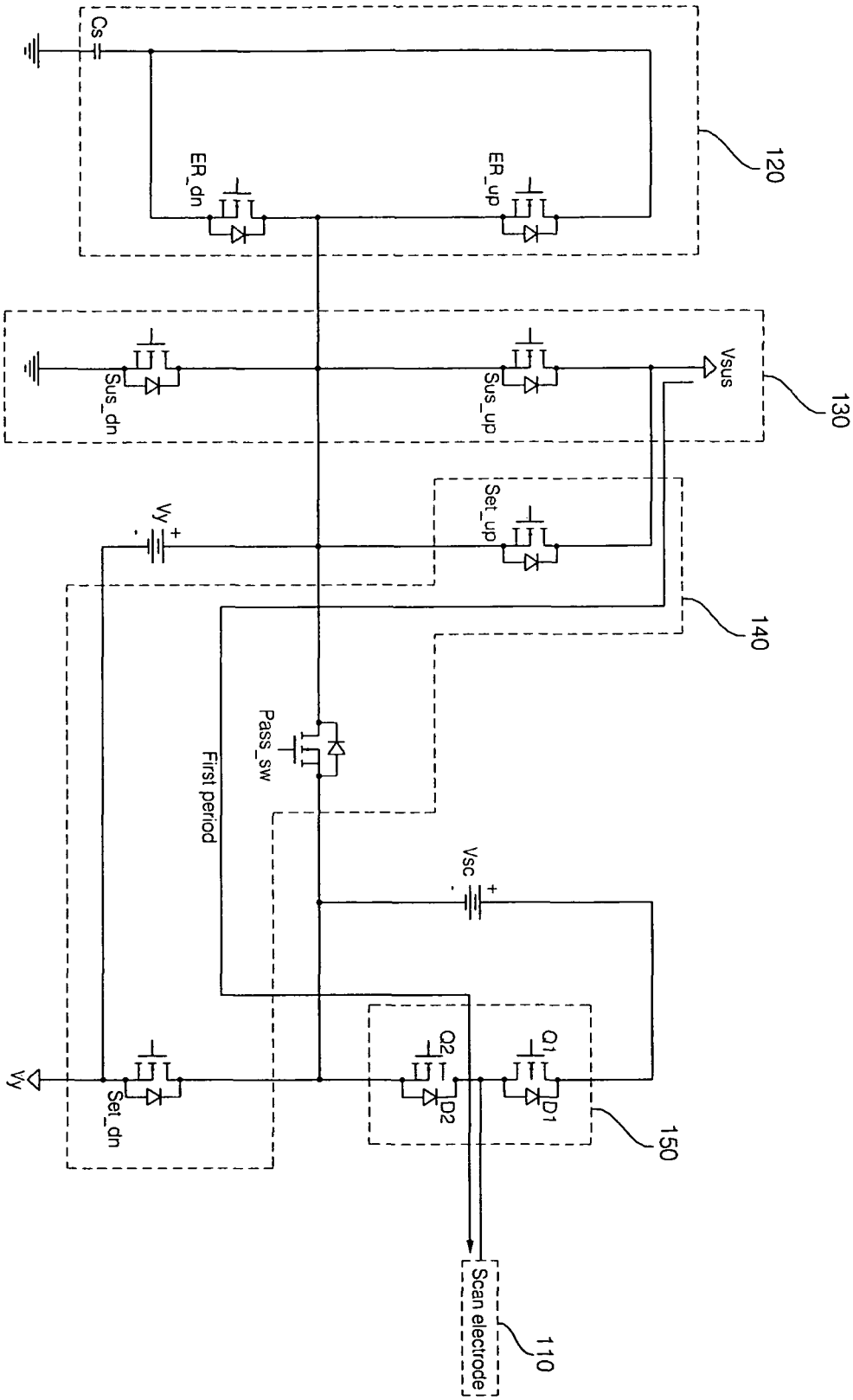
FIGS. 7A to 7C are circuit diagrams illustrating a flow of current of a scan driving circuit in response to a driving signal supplied to a plasma display panel during a setup period.
Figure 7B:
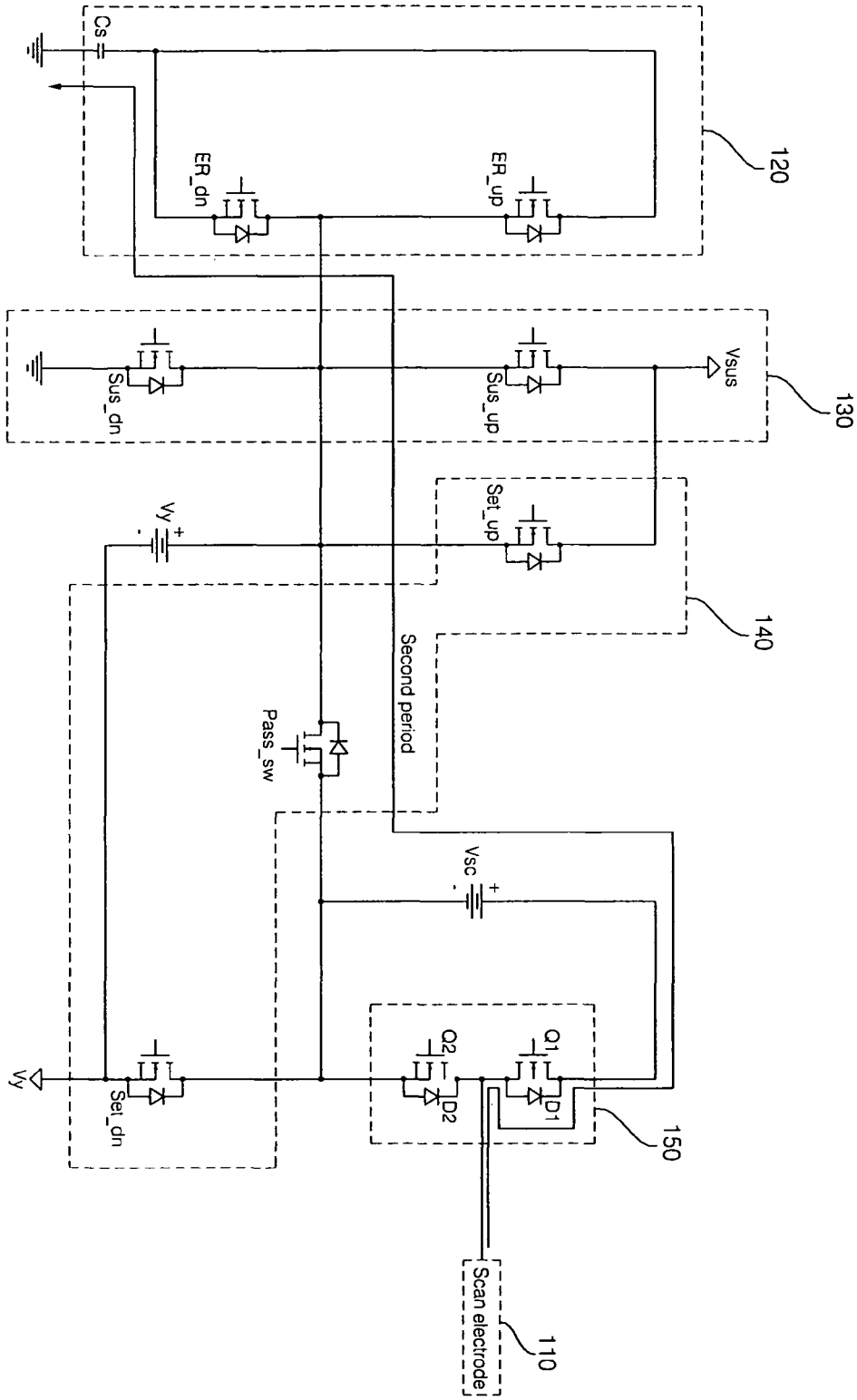
Figure 7C:
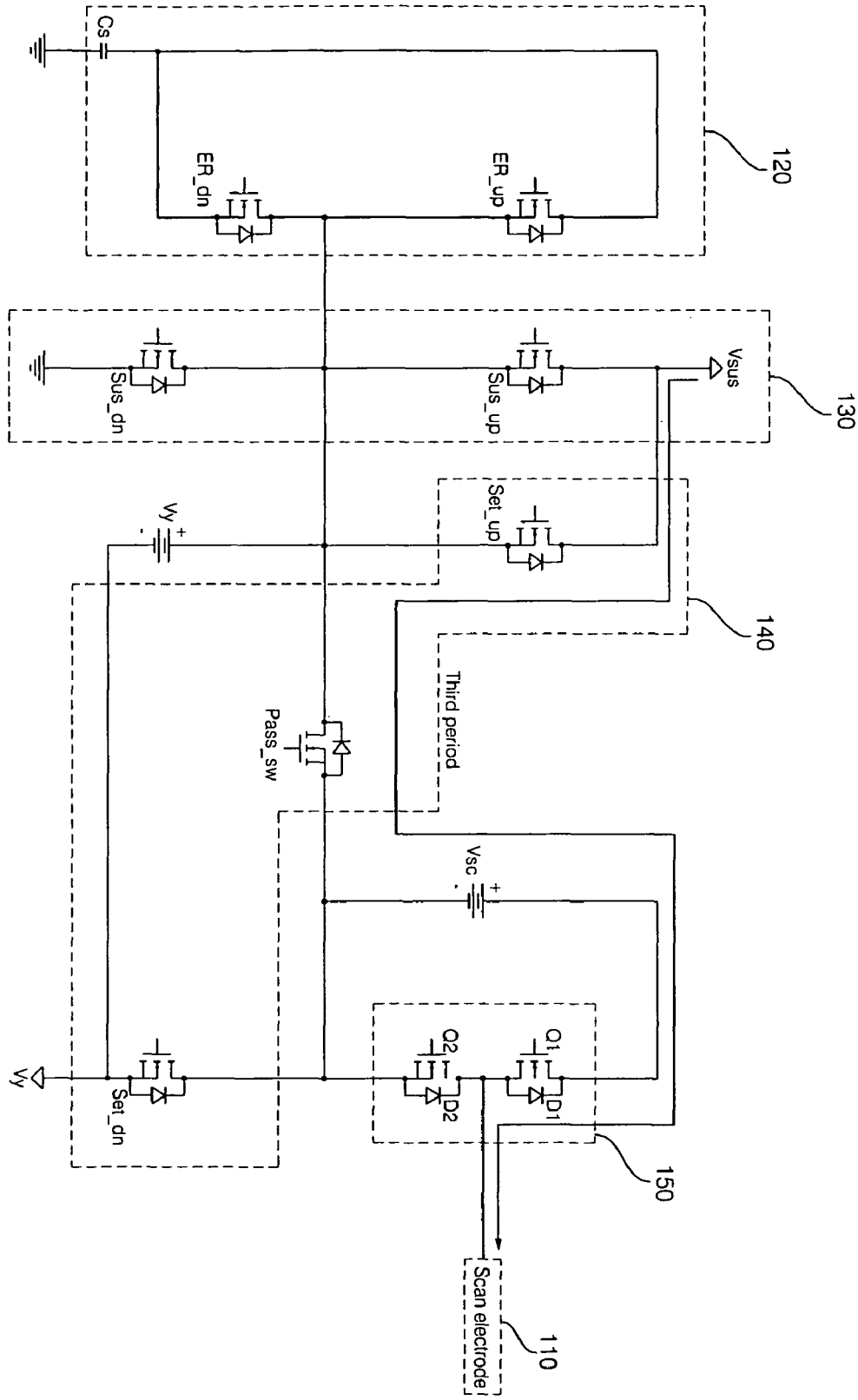

FIG. 6 is an exploded timing diagram illustrating a setup period of a driving signal supplied to the plasma display panel. FIGS. 7A to 7C are circuit diagrams illustrating current pass paths for a flow of current of the scan driving circuit in response to the driving signal applied to the plasma display panel during the setup period.

FIG. 6 shows a detail of an "A" range shown in FIG. 4. As shown, FIG. 6 shows the first period for supplying the first setup signal, the second period for falling by the predetermined voltage at an end time point of the first setup signal, and sustaining a fall voltage, and the third period for supplying the second setup signal in the second period.

In the first period, the pass switch (Pass_sw), the setup switch (Set_up), and the second switch (Q2) turn on, and the supply switch (ER_up), the recovery switch (ER_dn), the sus-up switch (Sus_up), the sus-down switch (Sus_dn), and the first switch (Q1) turn off, so that the scan driving circuit supplies the first setup signal to the scan electrode 110.

In the second period, the pass switch (Pass_sw) and the recovery switch (ER_dn) turn on, and the setup switch (Set_up), the supply switch (ER_up), the sus-up switch (Sus_up), the sus-down switch (Sus_dn), the first switch (Q1), and the second switch (Q2) turn off, to fall by the predetermined voltage from the first setup voltage and sustain a fall voltage falling from the scan driving circuit to the scan electrode 110.

In the third period, the pass switch (Pass_sw), the first switch (Q1), and the setup switch (Set-up) turn on, and the second switch (Q2), the supply switch (ER_up), the recovery switch (ER_dn), the sus-up switch (Sus_up), and the sus-down switch (Sus_dn) turn off so that the scan driving circuit supplies the second setup signal to the scan electrode 110.

A description of the first period will be made using the current pass path shown in FIG. 7A. First, in the first period, the setup switch (Set_up) of the reset driving unit 140 and the second switch (Q2) of the scan IC 50, which connect with the first power source (Vsus) for supplying the sustain voltage (Vsus), turn on, thereby connecting to the scan electrode 110 so that the first setup signal gradually rising from the ground voltage (GND) to the sustain voltage (Vsus) is applied to the scan electrode 110.

The setup switch (Set-up) supplies the first setup signal, which gradually rises to the sustain voltage (Vsus) by controlling the resistance of the variable resistor (not shown), to the scan electrode 110 through the second switch (Q2) of the scan IC 150.

Thus, the scan electrode 110 initializes the discharge cell by the first setup signal.

A description of the second period shown in FIG. 6 will be made using the current pass path of FIG. 7B. First, the second period is a period for falling by the predetermined voltage from the sustain voltage (Vsus) of the first period.

In other words, the current pass path of the second period simultaneously turns off the first switch (Q1) and the second switch (Q2) of the scan IC 150 for a predetermined time, and connects to the first diode (D1) connecting with the scan electrode 110, the external power source (Vsc), the pass switch (Pass_sw), and the recovery switch (ER_dn) and the capacitor (Cs) of the energy recovery unit 120, to recover a predetermined voltage from the scan electrode 110 so that the sustain voltage (Vsus) supplied to the scan electrode 110 is applied to the energy recovery unit 120 through the first diode (D1) connecting in parallel with the first switch (Q1).

The predetermined voltage, a difference voltage between the sustain voltage (Vsus) and the scan voltage (Vsc), is about 20V to 50V, and is variable depending on a capacitance of the capacitor (Cs) of the energy recovery unit 120.

It is desirable that the predetermined time is about 8 μs to 12 μs, and is variable depending on the capacitance of the capacitor (Cs).

A description of the third period shown in FIG. 6 will be made using the current pass path of FIG. 7C. First, the third period is a period for gradually rising from the voltage of the second period to the sum voltage of the sustain voltage (Vsus) and the scan voltage (Vsc).

In other words, the current pass path of the third period turns on the first switch (Q1) of the scan IC 150, and applies the sum voltage of the sustain voltage (Vsus) and the scan voltage (Vsc) to the scan electrode 110. In other words, the current pass path turns on the setup switch (Set_up) and the pass switch (Pass_sw) for supplying the sustain voltage (Vsus), the first power source (Vsc) for supplying the scan voltage (Vsc), and the first switch (Q1) of the scan IC 150, thereby connecting with the scan electrode 110.

Accordingly, the scan electrode 110 receives the first setup signal for supplying the sustain voltage (Vsus) of the first period, and the second setup signal for supplying the sum voltage of the sustain voltage (Vsus) and the scan voltage (Vsc) of the second period.

A comparison of the present invention with the conventional art will be made. In the conventional art, a first switch (Q1) of a scan IC 150 turns on, and a sus-down switch (Sus_dn) of a sustain driving unit 130 turns on, thereby connecting with the ground (GND) so that a first setup signal is supplied to a scan electrode 110.

In order to supply a second setup signal, the first switch (Q1) turns off, and a second switch (Q2) complementarily turns on, thereby inducing a sudden rise by a scan voltage (Vsc) and inducing a gradual rise by a sustain voltage (Vsus). Here, the conventional art has a drawback that, when the first and second switches (Q1) and (Q2) are simultaneously switched and spontaneously short-circuited due to each of their parasitic capacitors, thereby generating a peaking current.

The present invention supplies the first setup signal and then, in the second period, simultaneously turns off the first and second switches (Q1) and (Q2) for a predetermined time, and turns on the recovery switch (ER_dn) of the energy recovery unit 120 to lower by a predetermined voltage the sustain voltage (Vsus) supplied to the scan electrode 110 through the first diode (D1), thereby inducing a recovery to the capacitor (Cs).

The predetermined time varies depending on a recovery time based on the capacitance of the capacitor (Cs), and is about 8 μs to 12 μs. It is desirable that the predetermined voltage is 20V to 50V.

In the third period, the scan IC 150 turns on the first switch (Q1) to supply the second setup signal to the scan electrode 110, and sustains the second switch (Q2) in an off state. Therefore, the peaking current is prevented from resulting from the spontaneous short-circuit caused by the simultaneous switching of the first and second switches (Q1) and (Q2).

Figure 8:
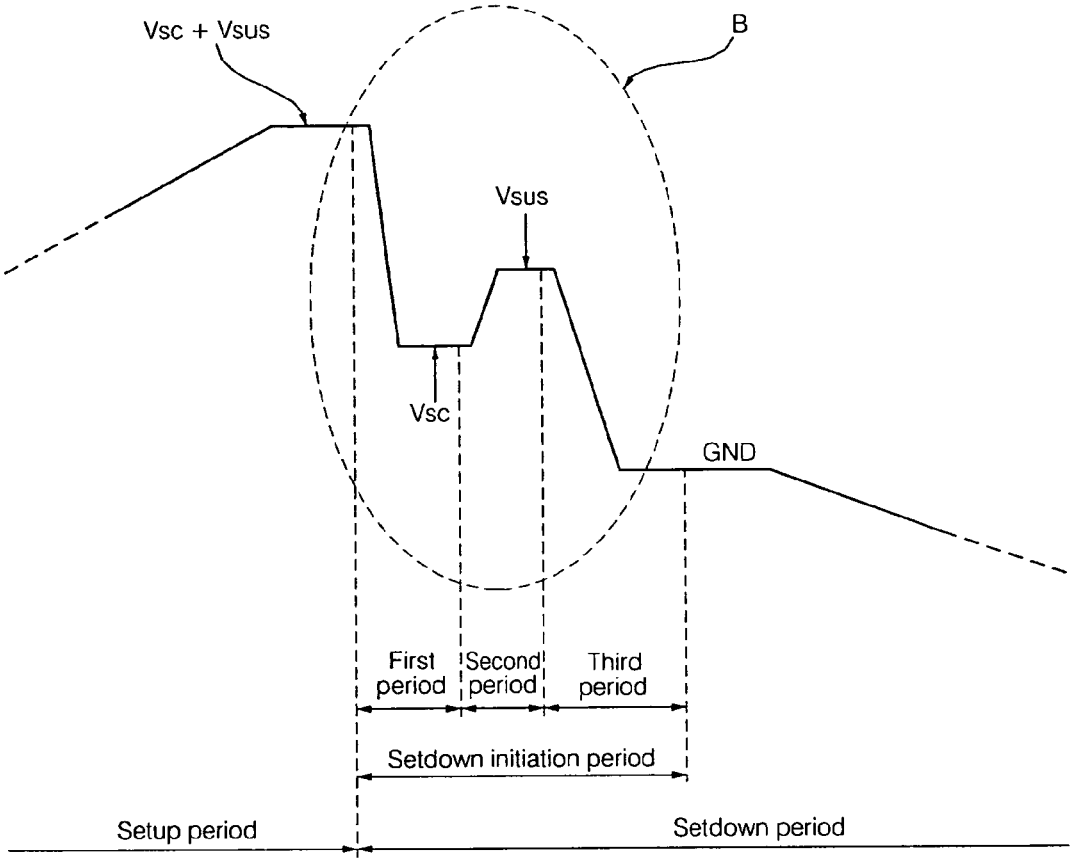
FIG. 8 is an exploded timing diagram illustrating a setdown period of a driving signal supplied to a plasma display panel.
Figure 9A:
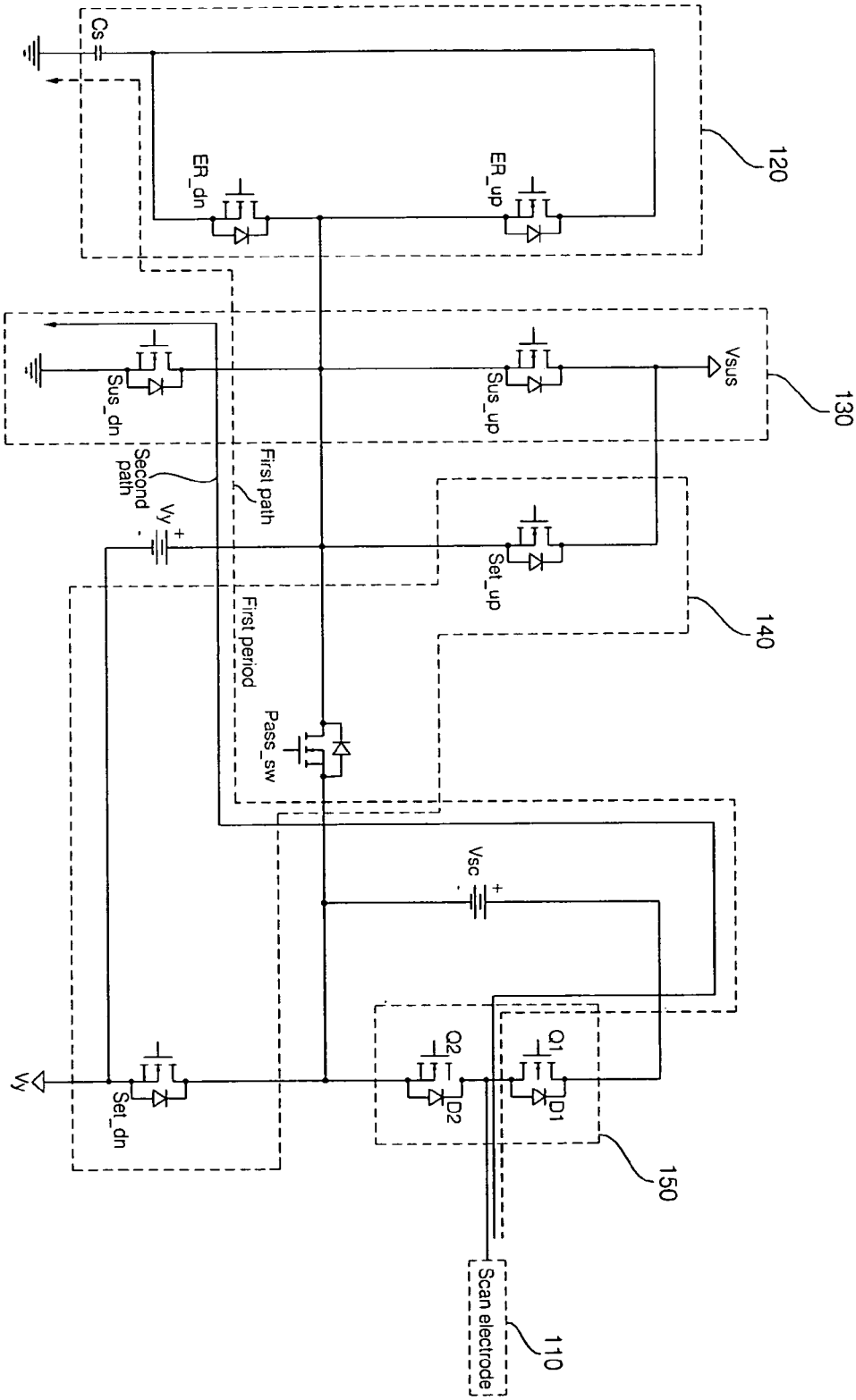
FIGS. 9A to 9C are circuit diagrams illustrating a flow of current of a scan driving circuit in response to a driving signal applied to a plasma display panel during a setdown period.
Figure 9B:
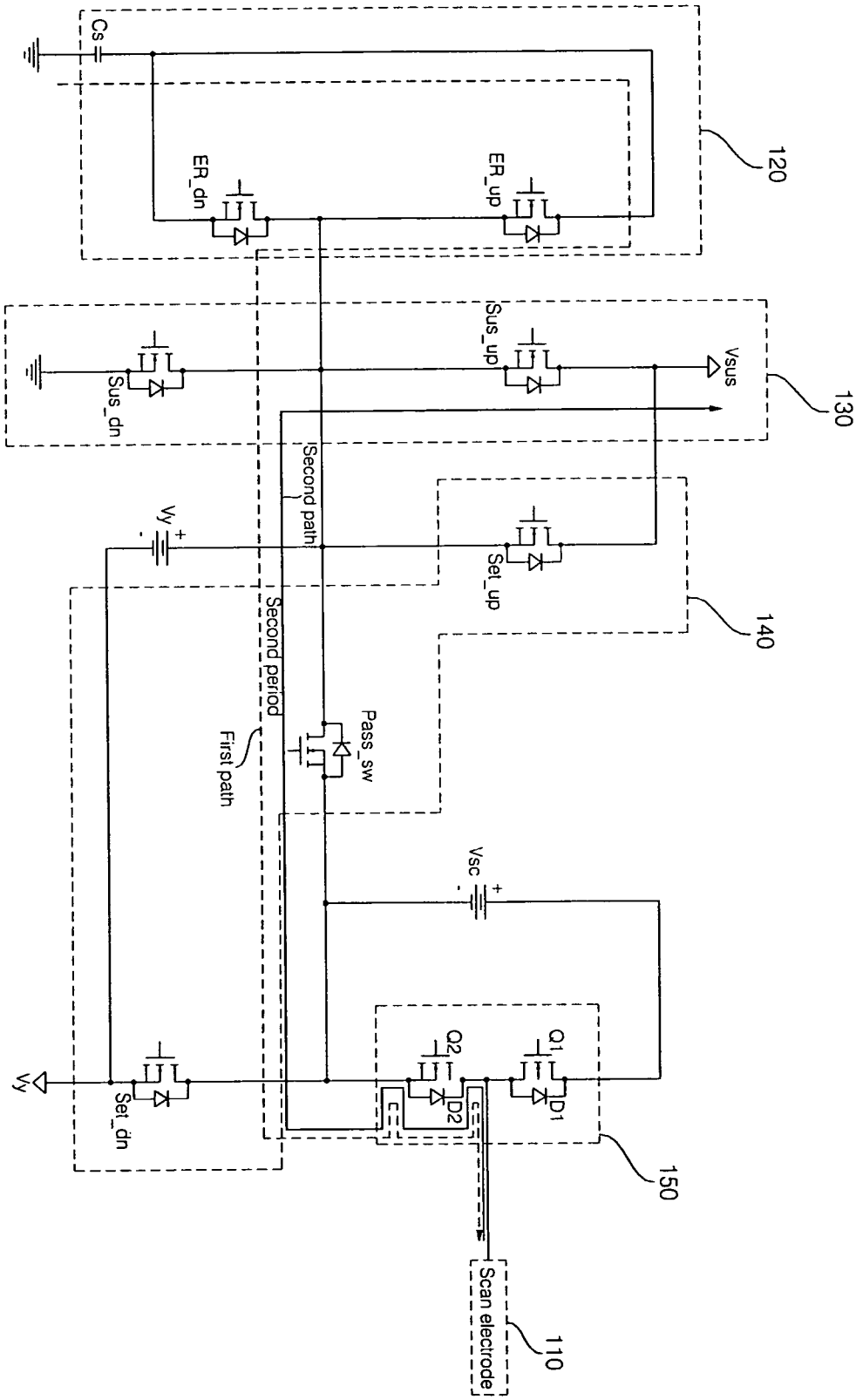
Figure 9C:
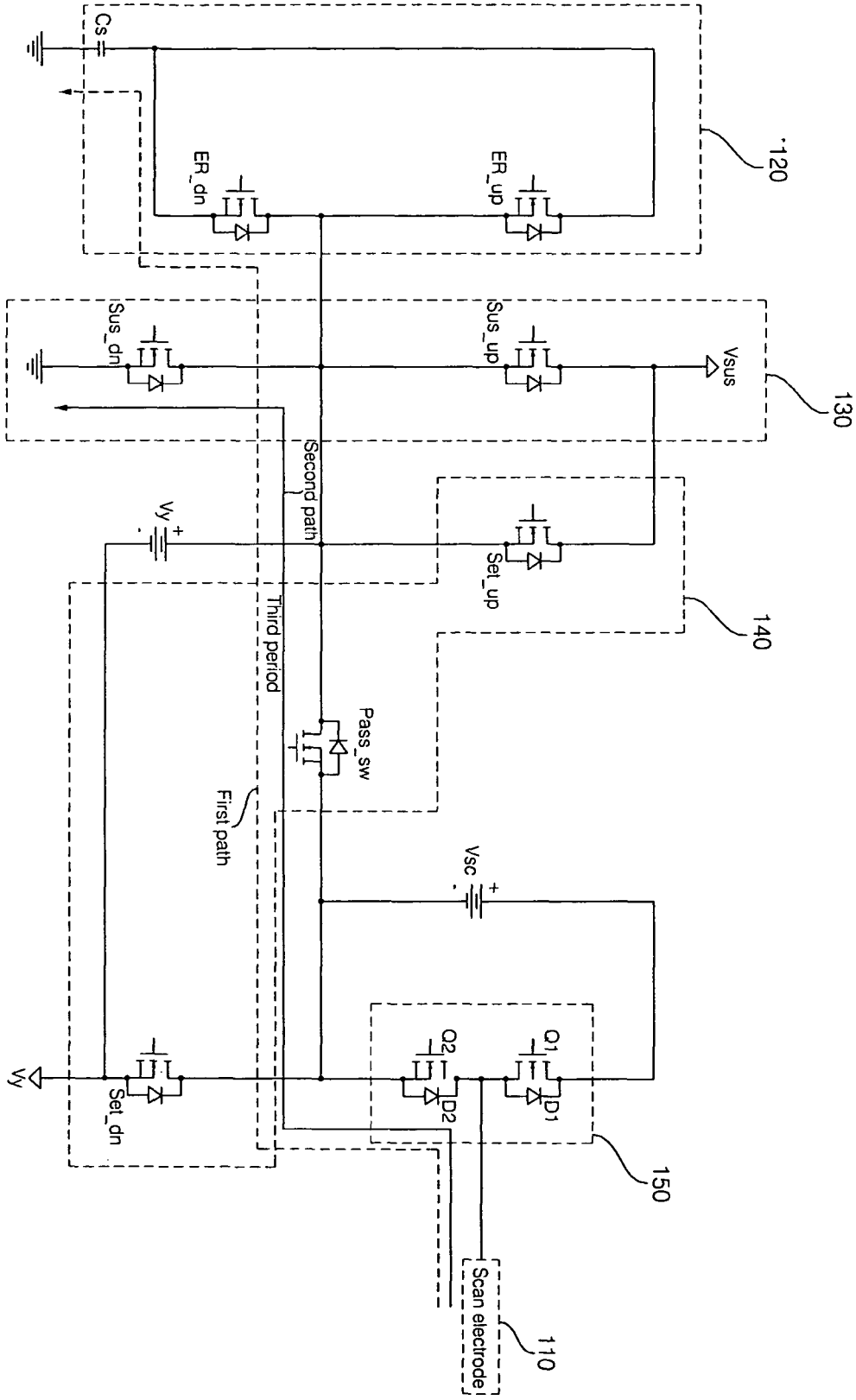

FIG. 8 is an exploded view illustrating a "B" range of the setdown period of the driving signal shown in FIG. 6. FIGS. 9A to 9C are circuit diagrams illustrating current pass paths for a flow of current of the scan driving circuit in response to the driving signal applied to the plasma display panel during the setdown period. A description will be made as in FIG. 4.

FIG. 8 shows a detail of the "B" range shown in FIG. 4. As shown, FIG. 8 shows the first period for falling by the sustain voltage (Vsus) from the sum voltage of the sustain voltage (Vsus) and the scan voltage (Vsc) of the second setup signal, the second period for rising by the predetermined voltage from the voltage of the first period, and the third period for falling from the voltage of the second period to the ground (GND) voltage.

In the first period, the first switch (Q1), the pass switch (Pass_sw), and the recovery switch (ER_dn) turn on and then, the first switch (Q1), the pass switch (Pass_sw), and the sus-down switch (Sus_dn) turn on, so that the scan driving circuit supplies a fall voltage, which falls by the sustain voltage (Vsus) from the sum voltage of the sustain voltage (Vsus) and the scan voltage (Vsc) of the second setup signal, to the scan electrode 110.

In the second period, the pass switch (Pass_sw) and the supply switch (ER_up) turn on and then, the pass switch (Pass_sw) and the sus-up switch (Sus_up) turn on, to rise by the predetermined voltage from the voltage of the first period and sustain a rise voltage from the scan driving circuit to the scan electrode 110. Also, the recovery switch (ER_dn), the setup switch (Set_up), the sus-down switch (Sus_dn), the first switch (Q1), and the second switch (Q2) turn off.

In the third period, the second switch (Q2), the pass switch (Pass_sw), and the recovery switch (ER_dn) turn on and then, the second switch (Q2), the pass switch (Pass_sw), and the sus-down switch (Sus_dn) turn on, so that the voltage of the second period falls to the ground (GND) voltage from the scan driving circuit to the scan electrode 110.

A description of the first period shown in FIG. 8 will be made using the current pass path shown in FIG. 9A. First, the first period is a period for falling by the sustain voltage (Vsus) from the sum voltage of the sustain voltage (Vsus) and the scan voltage (Vsc) supplied to the scan electrode 110.

In other words, a first current pass path of the first period turns on the first switch (Q1) of the scan IC 150 connecting with the second power source (Vsc) for supplying the scan voltage (Vsc) and the scan electrode 110, and turns on the recovery switch (ER_dn) of the energy recovery unit 120, thereby connecting with the capacitor (Cs).

Thus, the scan electrode 110 receives a fall voltage falling by the scan voltage (Vsc) from the sum voltage of the sustain voltage (Vsus) and the scan voltage (Vsc).

A second current pass path of the first period turns on the first switch (Q1) of the scan IC 150 connecting with the second power source (Vsc) for supplying the scan voltage (Vsc) and the scan electrode 110, and turns on the sus-down switch (Sus_dn) of the sustain driving unit 130, thereby connecting with the ground (GND).

The scan electrode 110 sustains the fall voltage falling by the sustain voltage (Vsus) from the sum voltage of the sustain voltage (Vsus) and the scan voltage (Vsc).

In the first period, there is not a sudden fall due to charging of the capacitor (Cs).

A description of the second period shown in FIG. 8 will be made using the current pass path of FIG. 9B. First, the second period is a period for rising by a predetermined voltage from the fall voltage falling by the scan voltage (Vsc).

In other words, the first current pass path of the second period simultaneously turns off the first switch (Q1) and the second switch (Q2) of the scan IC 150 for a predetermined time, and turns on the second diode (D2) connecting in parallel with the second switch (Q2) to the scan electrode 110, and the pass switch (Pass_sw) of the reset driving unit 140, thereby connecting with the capacitor (Cs) through the supply switch (ER_up) of the energy recovery unit 120.

The scan electrode 110 receives the sustain voltage (Vsus) from the capacitor (Cs) of the energy recovery unit 120, to induce a rise by a predetermined voltage.

It is desirable that the predetermined voltage is about 20V to 50V, and a time for simultaneously turning off the first and second switches (Q1) and (Q2) is about 8 μs to 12 μs.

The second current pass path of the second period simultaneously turns off the first and second switches (Q1) and (Q2) of the scan IC 150, and turns on the second diode (D2) connecting in parallel with the second switch (Q2) to the scan electrode 110, and the pass switch (Pass_sw) of the reset driving unit 140, thereby connecting with the sus-up switch (Sus_up) of the sustain driving unit 130.

The scan electrode 110 receives the voltage transmitted to the first current pass path, that is, the sustain voltage (Vsus).

A description of the third period shown in FIG. 8 will be made using the current pass path of FIG. 9C. First, the third period is a period for falling from a rise voltage rising by the sustain voltage (Vsus), to the ground (GND).

In other words, a first current pass path of the third period turns on the scan electrode 110 and the second switch (Q2) of the scan IC 150, and turns on the recovery switch (ER_dn) of the energy recovery unit 120, thereby connecting with the capacitor (Cs).

Thus, the capacitor (Cs) recovers by the sustain voltage (Vsus) from the scan electrode 110.

Also, a second current pass path of the third period turns on the second switch (Q2) of the scan IC 150 connecting with the scan electrode 110, and turns on the sus-down switch (Sus_dn) of the sustain driving unit 130, thereby connecting with the ground (GND).

The scan electrode 110 has a fall to the ground voltage (GND).

In other words, in case where the scan electrode 110 has the fall to the ground voltage (GND), the first current pass path turns off the recovery switch (ER_dn), and turns on the sus-down switch (Sus_dn) of the sustain driving unit 130 connecting with the ground (GND), thereby sustaining the ground voltage (GND).

A comparison of the present invention with the conventional art will be made. In the conventional art, in order to fall from the sum voltage of the sustain voltage (Vsus) and the scan voltage (Vsc) to a ground voltage (GND) in a setdown initiation period for falling to the ground voltage (GND) before application of the setdown signal after application of the setup signal, the scan IC 150 turn on the sus-down switch (Sus_dn) of the sustain driving unit 130 and connect with the scan electrode 110, and connect with the ground (GND). The conventional art has a drawback that, when the first and second switches (Q1) and (Q2) are simultaneously switched and spontaneously short-circuited by each of their parasitic capacitors, thereby generating the peaking current.

In the present invention, in the setdown initiation period before application of the setdown signal after application of the setup signal, in state where the first switch (Q1) turns on, the recovery switch (ER_dn) of the energy recovery unit 120 turns on, thereby inducing the recovery to the capacitor (Cs) so that the fall is induced by the scan voltage (Vsc) from the sum voltage of the sustain voltage (Vsus) and the scan voltage (Vsc) supplied to the scan electrode 110.

In the scan electrode 110, after the fall is induced by the scan voltage (Vsc), the first and second switches (Q1) and (Q2) simultaneously turn off, thereby inducing the rise by the sustain voltage (Vsus) recovered to the capacitor (Cs) through the second diode (D2) by turning on the supply switch (ER_up). After that, the recovery switch (ER_dn) turns on, thereby inducing and sustaining the fall to the ground voltage (GND).

Thus, in the second period for rising by the sustain voltage (Vsus), the peaking current is prevented from resulting from the spontaneous short-circuit caused by the simultaneous switching of the first and second switches (Q1) and (Q2).

Figure 10:
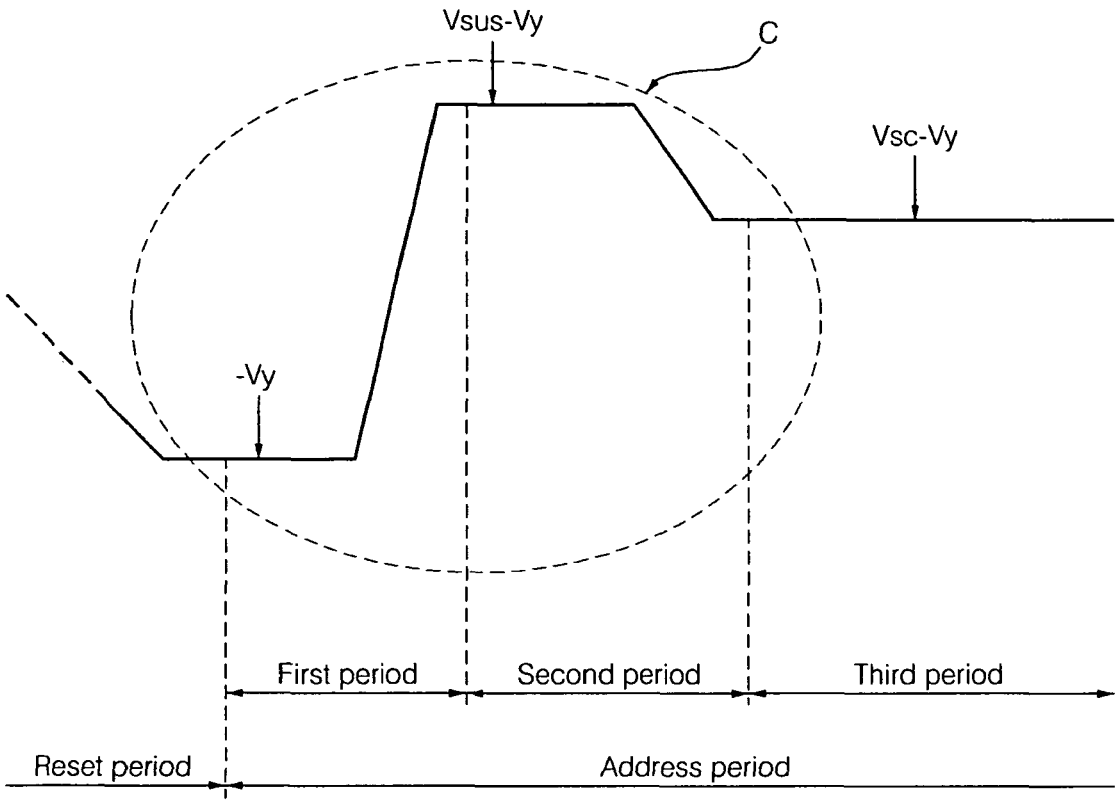
FIG. 10 is an exploded timing diagram illustrating an address period of a driving signal supplied to a plasma display panel.
Figure 11A:
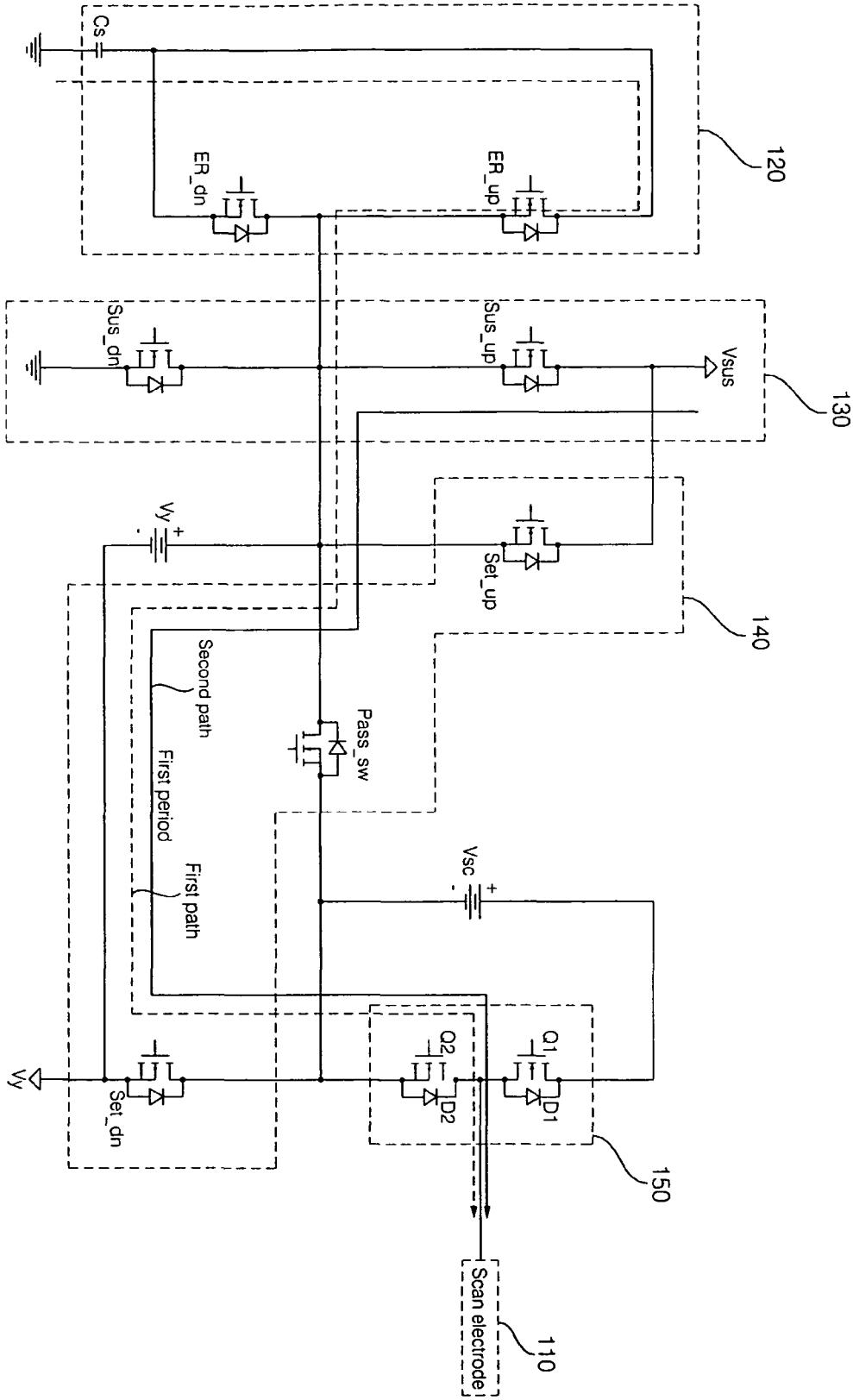
FIGS. 11A to 11C are circuit diagrams illustrating a flow of current of a scan driving circuit in response to a driving signal applied to a plasma display panel during an address period.
Figure 11B:
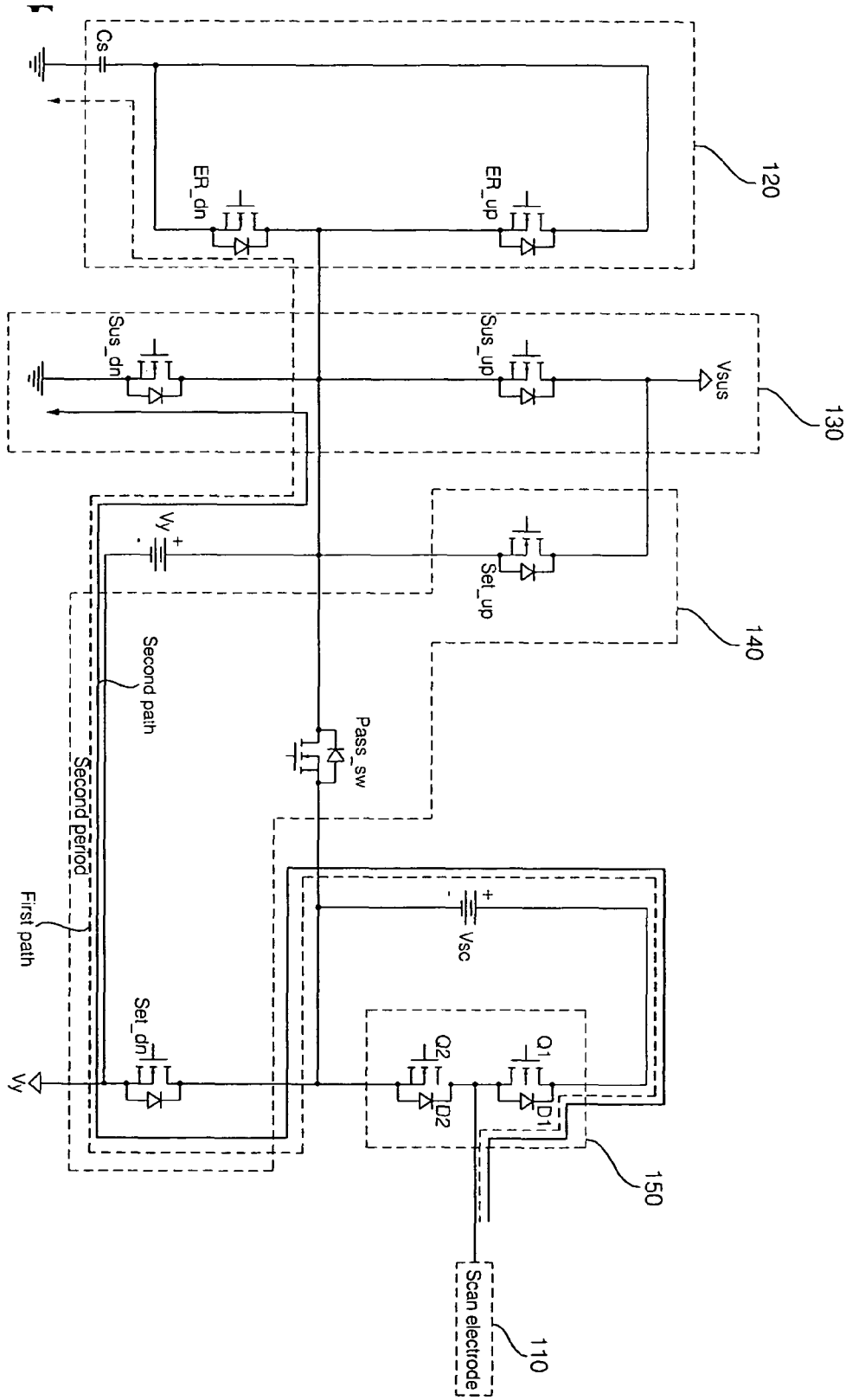
Figure 11C:
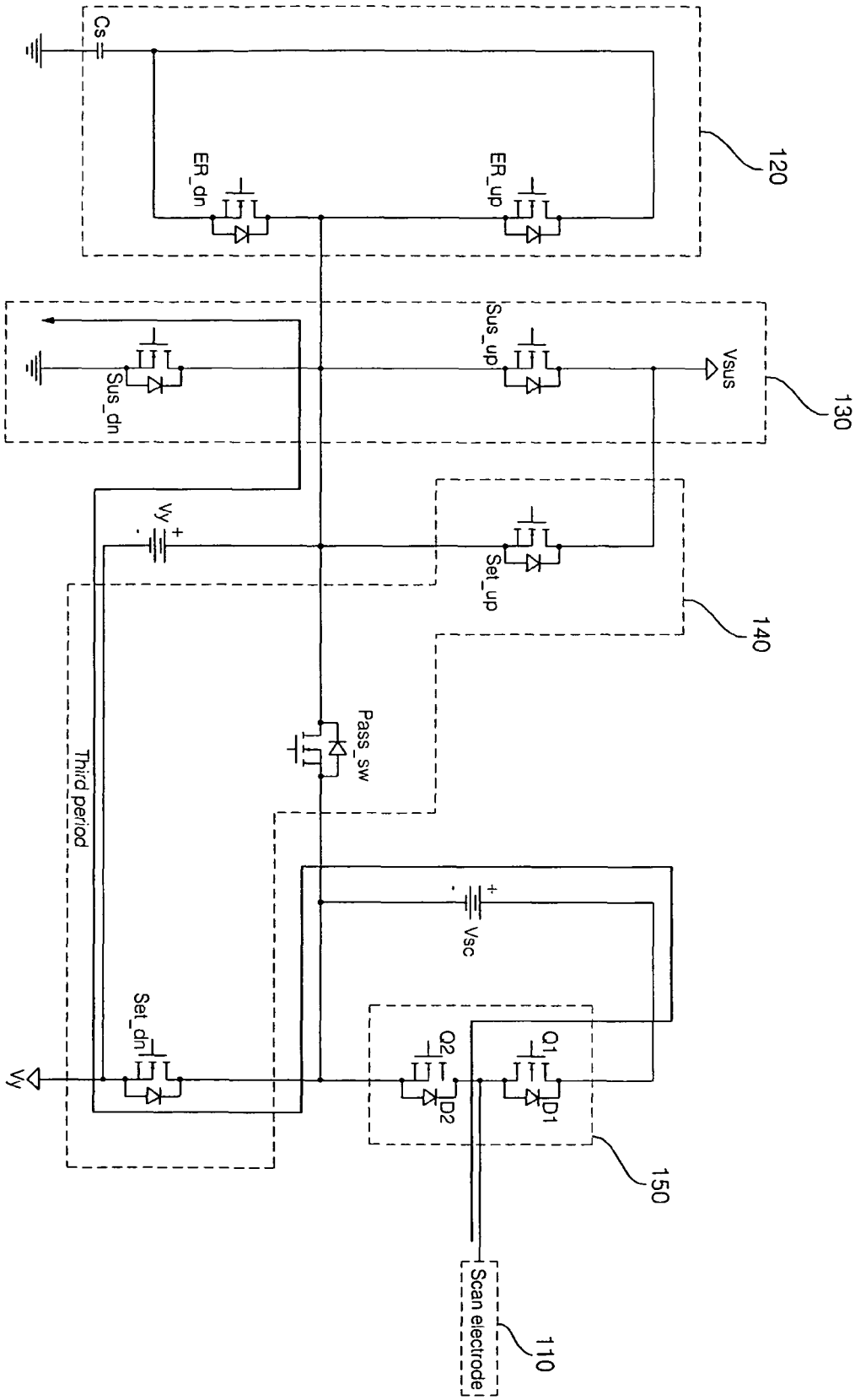

FIG. 10 is an exploded view illustrating a "C" range of the setdown period of the driving signal shown in FIG. 6. FIGS. 11A to 11C are circuit diagrams illustrating current pass paths for a flow of current of the scan driving circuit in response to the driving signal applied to the plasma display panel during the address period. A description will be made as in FIG. 4.

FIG. 10 shows a detail of the "C" range shown in FIG. 4. As shown, FIG. 11 shows the first period for rising by the sustain voltage (Vsus) from the voltage of the setdown signal gradually falling to the negative voltage (−Vy), and the second period for falling from the voltage of the first period by a predetermined voltage, and a third period for sustaining the voltage of the second period.

In the first period, the second switch (Q2), the setdown switch (Set_dn), and the supply switch (ER_up) turn on and then, the second switch (Q2), the setdown switch (Set_dn), and the sus-up switch (Sus_up) turn on, so that the scan driving circuit supplies the rise voltage, which rises by the sustain voltage (Vsus) from the negative voltage (−Vy) of the setdown signal, to the scan electrode 110.

In the second period, the setdown switch (Set_dn) and the recovery switch (ER_dn) turn on and then, the setdown switch (Set_dn) and the sus-down switch (Sus_dn) turn on, so that the scan driving circuit supplies the fall voltage falling by the predetermined voltage from the voltage of the first period, to the scan electrode.

In the third period, the first switch (Q1) and the sus-down switch (Sus_dn) turn on so that the voltage of the second period is sustained from the scan driving circuit to the scan electrode 110.

A description of the first period shown in FIG. 10 will be made using the current pass path shown in FIG. 11A. First, the first period is a period for falling by the sustain voltage (Vsus) from the negative voltage (−Vy) of the setdown signal supplied to the scan electrode 110.

In other words, a first current pass path of the first period turns on the first switch (Q1) of the scan IC 150 connecting with the scan electrode 110, turns on the setdown switch (Set_dn) of the reset driving unit 140, and turns on the recovery switch (ER_dn) of the energy recovery unit 120, thereby connecting with the capacitor (Cs).

Thus, the scan electrode 110 receives the rise voltage rising by the sustain voltage (Vsus) recovered to the capacitor (Cs).

A second current pass path of the first period turns on the second switch (Q2) of the scan IC 150 connecting with the scan electrode 110, turns on the setdown switch (Set_dn) of the reset driving unit 140, and turns the sus-up switch (Sus_up) of the sustain driving unit 130, thereby connecting with the first power source (Vsus).

The scan electrode 110 sustains the voltage applied from the first current pass path.

A description of the second period shown in FIG. 10 will be made using the current pass path of FIG. 11B. First, the second period is a period for supplying and sustaining a fall voltage falling by a predetermined voltage from the voltage of the first period.

In other words, the first current pass path of the second period simultaneously turns off the first switch (Q1) and the second switch (Q2) of the scan IC 150, and turns on the first diode (D1) connecting in parallel with the first switch (Q1) to the scan electrode 110, and the setdown switch (Set_dn) of the reset driving unit 140, thereby connecting with the capacitor (Cs) through the recovery switch (ER_dn) of the energy recovery unit 120.

The scan electrode 110 has a fall by the predetermined voltage from the rise voltage of the first period.

It is desirable that the predetermined voltage is about 20V to 50V, and a time for simultaneously turning off the first and second switches (Q1) and (Q2) is about 8 μs to 12 μs.

The second current pass path of the second period simultaneously turns off the first and second switches (Q1) and (Q2) of the scan IC 150, and turns on the first diode (D1) connecting in parallel with the first switch (Q1) to the scan electrode 110, and the setdown switch (Set_dn) of the reset driving unit 140, thereby connecting with the ground (GND) through the sus-down switch (Sus_dn) of the sustain driving unit 130.

The scan electrode 110 sustains the voltage transmitted to the first current pass path.

A description of the third period shown in FIG. 10 will be made using the current pass path of FIG. 11C. First, the third period is a period for sustaining the voltage of the second period.

In other words, the current pass path of the third period simultaneously turns on the first switch (Q1) of the scan IC 150, and turns on the setdown switch (Set_dn) of the reset driving unit 140, thereby connecting with the ground (GND) through the sus-down switch (Sus_dn) of the sustain driving unit 130.

Thus, the scan electrode 110 sustains the voltage of the second period, that is, the scan bias voltage (Vsc−Vy).

In the conventional scan IC 150, the first and second switches (Q1) and (Q2) change in state and complementarily turn on or off, thereby inducing a rise to the scan bias voltage (Vsc−Vy). However, in the scan IC 150 according to the present invention, the rise voltage rising by the sustain voltage (Vsus) stored in the capacitor (Cs) of the energy recovery unit 120 without the switching change of the first and second switches (Q1) and (Q2) is supplied to the scan electrode 110.

As a result, in the address initiation period, a higher voltage than the scan bias voltage (Vsc−Vy) is applied. In order to fall to the scan bias voltage (Vsc−Vy), the first and second switches (Q1) and (Q2) are simultaneously turned off. This will be described in the second period.

A comparison of the present invention with the conventional art will be made. In the conventional art, there is a drawback that, as the address period initiates, the first and second switches (Q1) and (Q2) are simultaneously switched and thus, one of the first and second switches (Q1) and (Q2) is short-circuited, thereby generating the peaking current. However, in the present invention, as the address period initiates, the first and second switches (Q1) and (Q2) induce the rise by the sustain voltage (Vsus) from the negative voltage (−Vy), without switching, so that one of the first and second switches (Q1) and (Q2) is prevented from being short-circuited due to the parasitic capacitor, and the first and second switches (Q1) and (Q2) turn off to induce the fall to the scan bias voltage (Vsc−Vy), thereby preventing the peaking current.

In the above constructed plasma display apparatus, the first and second switches of the scan IC turn off for a predetermined time, so that one of the first and second switches is prevented from being short-circuited due to the parasitic capacitor, and the same voltage is applied to both terminals so that the peaking current can be prevented from being applied to the scan IC.

Figure 12:
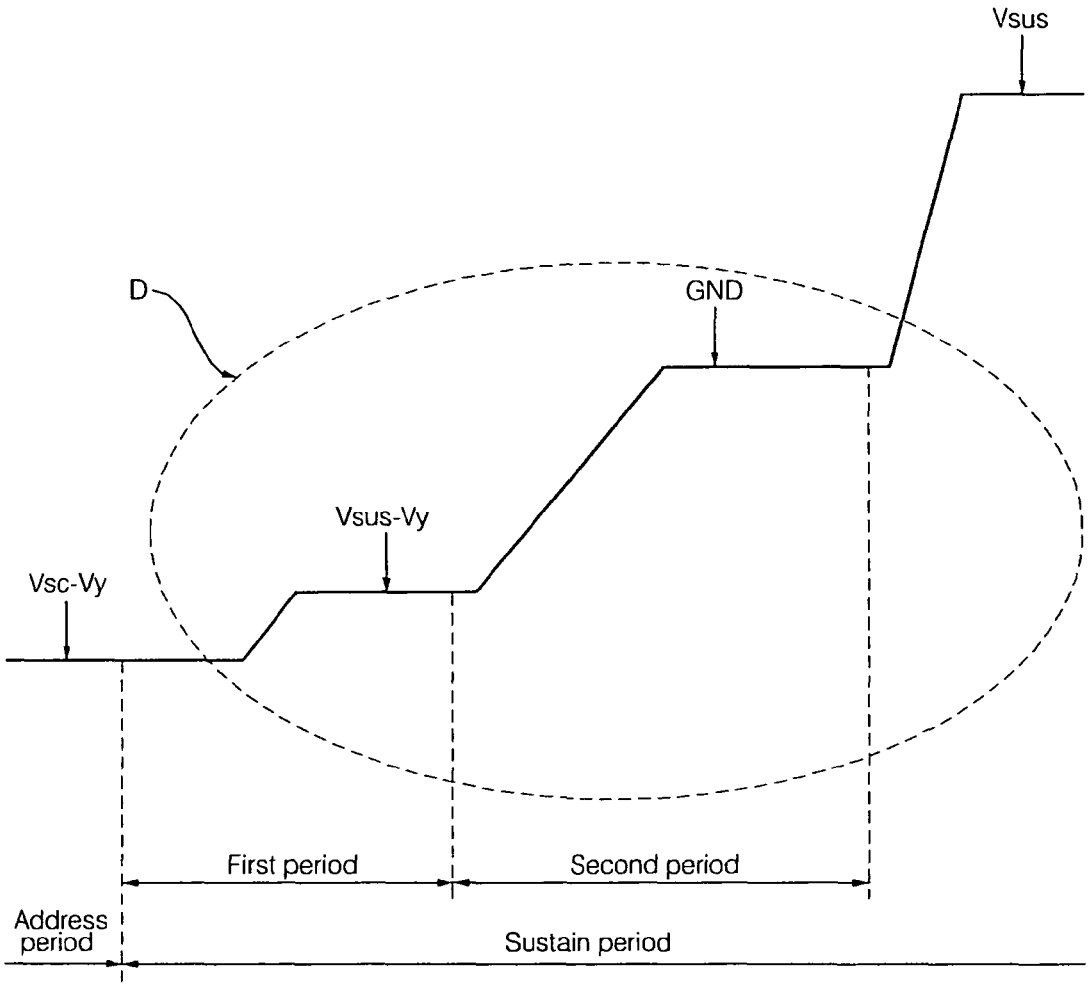
FIG. 12 is an exploded timing diagram illustrating a sustain period of a driving signal supplied to a plasma display panel.
Figure 13A:
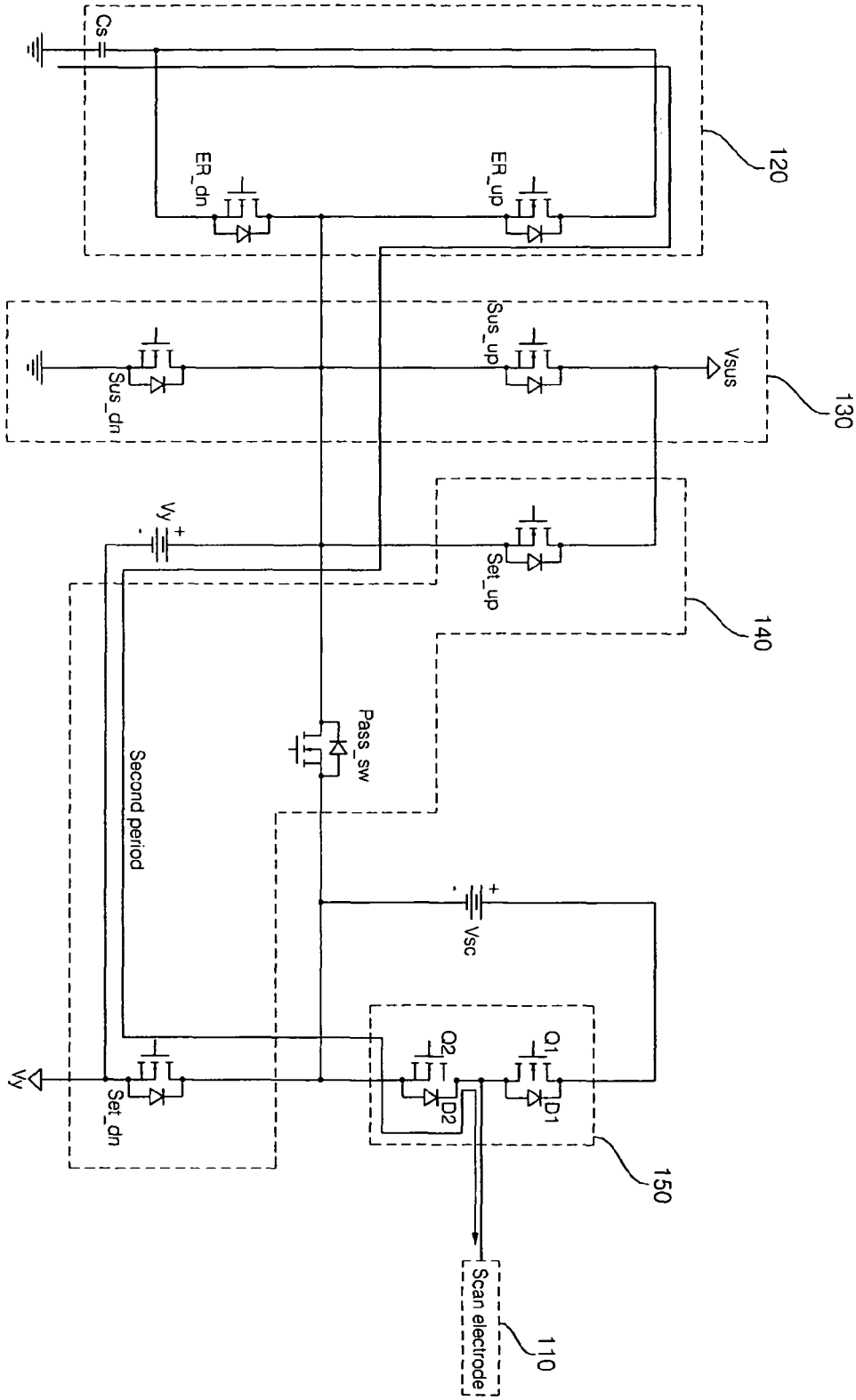
FIGS. 13A to 13B are circuit diagrams illustrating a flow of current of a scan driving circuit in response to a driving signal applied to a plasma display panel during a sustain period.

FIG. 12 is an exploded view illustrating a "D" range of the setdown period of the driving signal shown in FIG. 6. FIGS. 13A to 11B are circuit diagrams illustrating current pass paths for a flow of current of the scan driving circuit in response to the driving signal applied to the plasma display panel during the sustain period. A description will be made as in FIG. 4.

FIG. 12 shows a detail of the "D" range shown in FIG. 4. As shown, FIG. 12 shows the first period for rising by the predetermined voltage from the scan bias voltage (Vsc−Vy) in the address period, and the second period for rising from the voltage of the first period to the ground voltage (GND).

In the first period, the setdown switch (Set_dn) and the supply switch (ER_up) turn on so that the scan driving circuit supplies the rise voltage, which rises by the predetermined voltage from the scan bias voltage (Vsc_Vy), to the scan electrode 110.

In the second period, the second switch (Q2), the pass switch (Pass_sw), the sus-down switch (Sus_dn), and the recovery switch (ER_dn) turn on so that the scan driving circuit supplies the ground voltage (GND) rising from the voltage of the first period, to the scan electrode 110.

A description of the first period shown in FIG. 12 will be made using the current pass path shown in FIG. 13A. First, the first period is a period for rising by the predetermined voltage from the scan bias voltage (Vsc−Vy), to the scan electrode 110.

In other words, the current pass path of the first period turns off the first and second switch (Q1) and (Q2) of the scan IC 150 connecting with the scan electrode 110, turns on the second diode (D2) connecting in parallel with the second switch (Q2) and the setdown switch (Set_dn) of the reset driving unit 140, and turns on the supply switch (ER_up) of the energy recovery unit 120, thereby connecting with the capacitor (Cs).

Thus, the scan electrode 110 receives the rise voltage rising by the predetermined voltage from the scan bias voltage (Vsc−Vy), using the sustain voltage (Vsus) recovered to the capacitor (Cs).

It is desirable that the predetermined voltage is about 20V to 50V, and a time for simultaneously turning off the first and second switches (Q1) and (Q2) is about 8 μs to 12 μs.

Figure 13B:
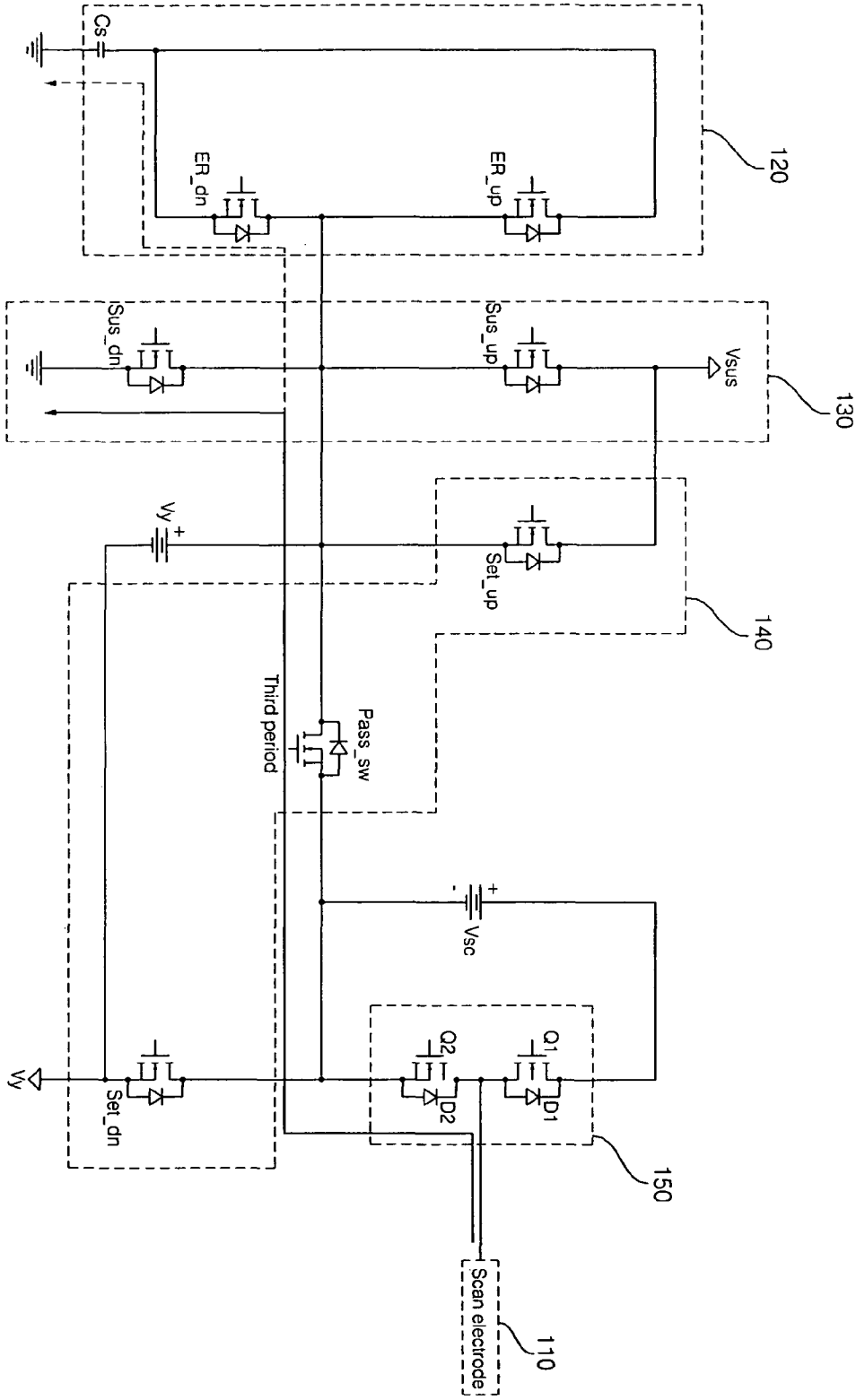

A description of the second period shown in FIG. 12 will be made using the current pass path of FIG. 13B. First, the second period is a period for rising from the voltage of the first period to the ground voltage (GND), to the scan electrode 110.

In other words, the first current pass path of the second period simultaneously turns on the second switch (Q2) of the scan IC 150 connecting with scan electrode 110, and turns on the pass switch (Pass_sw) of the reset driving unit 140, and, at this time, turns on the recovery switch (ER_dn) of the energy recovery unit 120 to sustain the voltage of the first period, thereby connecting with the capacitor (Cs). After that, the recovery switch (ER_dn) of the energy recovery unit 120 turns off, and the sus-down (Sus_dn) of the sustain driving unit 130 turns on.

Thus, the scan electrode 110 receives the rise voltage rising from the voltage of the first period to the ground voltage (GND).

In the conventional scan IC 150, the first and second switches (Q1) and (Q2) change in state and complementarily turn on or off, thereby inducing the rise from the scan bias voltage (Vsc−Vy) to the rise voltage (Vsus−Vy) by the sustain voltage (Vsus). However, in the scan IC 150 according to the present invention, the first and second switches (Q1) and (Q2) simultaneously turn off.

The first and second switches (Q1) and (Q2) of the scan IC 150 are sustained in the off state for a predetermined time. The predetermined time is a time for which the voltage supplied to the scan electrode 110 rises by the sustain voltage (Vsus), and is based on a range of about 8 μs to 12 μs depending on a supply of the capacitor (Cs).

A comparison of the present invention with the conventional art will be made. In the conventional art, there is a drawback that, as the sustain period initiates, the first and second switches (Q1) and (Q2) are simultaneously switched and thus, one of the first and second switches (Q1) and (Q2) is short-circuited, thereby generating the peaking current. However, in the present invention, as the sustain period initiates, the first and second switches (Q1) and (Q2) simultaneously turn off and perform the rise by the sustain voltage (Vsus) from the scan bias voltage (Vsc−Vy) so that one of the first and second switches (Q1) and (Q2) is prevented from being short-circuited due to the parasitic capacitor, and the first and second switches (Q1) and (Q2) turn on to induce the rise to the ground voltage (GND), thereby preventing the peaking current.

In the above constructed plasma display apparatus, the first and second switches of the scan IC turn off for a predetermined time, so that one of the first and second switches is prevented from being short-circuited due to the parasitic capacitor, and the same voltage is applied to both terminals so that the peaking current can be prevented from being applied to the scan IC.

An operation and an effect of the above constructed plasma display apparatus according to the present invention will be described below.

The present invention has an effect that the first and second switches (Q1) and (Q2) of the scan IC 150 simultaneously turn off for a predetermined time, thereby, when the first and second switches (Q1) and (Q2) are complementarily switched, preventing any one of the first and second switches (Q1) and (Q2) from being spontaneously short-circuited by the parasitic capacitor, preventing the peaking current from being introduced into the scan IC 150, preventing a damage of the scan IC 150, and improving a picture quality owing to the non-occurrence of the heat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus having a plasma display panel constituted of a plurality of discharge cells, and a driver for driving the panel, the apparatus comprising:

a scan IC (integrated circuit) having a first switch turning on to apply a first signal to the panel, and a second switch turning on to apply a second signal to the panel, wherein, when the first signal applied to the panel changes into the second signal, the first and second switches are floated between an application period of the first signal and an application period of the second signal, wherein the scan IC sequentially applies gradually rising first setup signal and second setup signal to the panel to initialize the plurality of discharge cells, and wherein the first and second switches are floated between an application period of the first setup signal and an application period of the second setup signal.

2. The apparatus of claim 1, wherein a cross terminal voltage of the second switch is the same at a time point of applying the second signal to the panel.

3. The apparatus of claim 1, wherein a voltage supplied to the panel rises or falls by 20V to 50V during floating periods of the first and second switches.

4. The apparatus of claim 1, wherein the first and second switches are floated during 8 μs to 12 μs.

5. The apparatus of claim 1, further comprising an energy recovery unit for recovering and storing energy supplied to the panel, and supplying the stored energy to the panel, wherein, while the first and second switches are floated, the energy recovery unit supplies the energy to the panel or recovers the energy from the panel.

6. The apparatus of claim 5, wherein a cross terminal voltage of the second switch is made identical by the energy supplied from or recovered to the energy recovery unit.

7. The apparatus of claim 1, wherein the scan IC further comprises a diode connecting between both terminals of the second switch, and flows an electric current to the diode while the first and second switches are floated.

8. The apparatus of claim 1, wherein the scan IC sequentially applies a gradually rising setup signal and a gradually falling setdown signal to the panel to initialize the plurality of discharge cells, and wherein the first and second switches are floated between an application period of the setup signal and an application period of the setdown signal.

9. The apparatus of claim 1, wherein the scan IC applies a gradually falling setdown signal to the panel to initialize the plurality of discharge cells and then, applies a scan signal for selecting the discharge cell to induce a discharge from the plurality of discharge cells, to the panel, and wherein the first and second switches are floated between an application period of the setdown signal and an application period of the scan signal.

10. The apparatus of claim 1, wherein the scan IC applies a scan signal for selecting the discharge cell to induce a discharge from the plurality of discharge cells, to the panel, and then applies a sustain signal to the panel to induce a sustain discharge in the selected discharge cell, and the first and second switches are floated between an application period of the scan signal and an application period of the sustain signal.

11. A plasma display apparatus having a plasma display panel constituted of a plurality of discharge cells, and a driver for driving the panel, the apparatus comprising:

an energy recovery unit for recovering and storing energy supplied to the panel, and supplying the stored energy to the panel;

a reset driving unit for generating a gradually rising setup signal and a gradually falling setdown signal to initialize the plurality of discharge cells; and a scan IC having a first switch turning on to apply the generated setup signal to the panel, and a second switch turning on to apply the setdown signal to the panel, wherein the first and second switches are floated between an application period of the setup signal and an application period of the setdown signal.

12. The apparatus of claim 11, wherein the setup signal comprises a first setup signal and a second setup signal gradually rising, respectively, and wherein the first and second switches are floated between an application period of the first setup signal and an application period of the second setup signal.

13. The apparatus of claim 11, wherein a cross terminal voltage of the second switch is the same at a time point of applying the setdown signal to the panel.

14. The apparatus of claim 11, wherein the scan IC further comprises a second diode connecting between both terminals of the second switch, and wherein, while the first and second switches are floated, energy is supplied from the energy recovery unit to the panel through the second diode.

15. The apparatus of claim 11, wherein the scan IC further comprises a first diode connecting between both terminals of the first switch, and wherein, while the first and second switches are floated between the first setup signal application period and the second setup signal application period, energy is recovered from the panel to the energy recovery unit through the first diode.

16. A plasma display apparatus having a plasma display panel, which is driven by dividing one subfield into a reset period for initializing a plurality of discharge cells, an address period for selecting the discharge cell to induce a discharge from the plurality of discharge cells, and a sustain period for generating a sustain discharge in the selected discharge cell, the apparatus comprising:

a scan IC having a first switch turning on to apply a first signal to the panel, and a second switch turning on to apply a second signal to the panel, wherein the first and second switches are floated between the address period and the sustain period, and wherein the scan IC further comprises a first diode connected between both terminals of the first switch, and wherein, while the first and second switches are floated between the reset period and the address period, energy is recovered from the panel to the energy recovery unit through the first diode.

17. The apparatus of claim 16, wherein the first and second switches are floated between the reset period and the address period.

18. The apparatus of claim 16, wherein the scan IC further comprises a second diode connecting between both terminals of the second switch, and wherein, while the first and second switches are floated, energy is supplied from the energy recovery unit to the panel through the second diode.

* * * * *